US007021749B2

(12) United States Patent
Akahane et al.

(10) Patent No.: US 7,021,749 B2
(45) Date of Patent: Apr. 4, 2006

(54) LIQUID EJECTION HEAD, AND METHOD OF MANUFACTURING THE SAME

(75) Inventors: Fujio Akahane, Nagano (JP); Nagamitsu Takashima, Nagano (JP); Akiharu Kurebayashi, Nagano (JP); Kazushige Hakeda, Nagano (JP); Ryoji Uesugi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 122 days.

(21) Appl. No.: 10/644,066

(22) Filed: Aug. 20, 2003

(65) Prior Publication Data

US 2005/0248626 A1 Nov. 10, 2005

(30) Foreign Application Priority Data

Aug. 20, 2002 (JP) ..... P2002-239561
Aug. 19, 2003 (JP) ..... P2003-295583

(51) Int. Cl.
*B41J 2/045* (2006.01)

(52) U.S. Cl. ..... 347/68; 347/71

(58) Field of Classification Search ..... 347/40, 347/47, 56, 68–73, 65, 67, 94; 29/890.1
See application file for complete search history.

(56) References Cited

U.S. PATENT DOCUMENTS 5,165,061 A * 11/1992 Witteveen ..... 347/40
6,045,215 A * 4/2000 Coulman ..... 347/47

FOREIGN PATENT DOCUMENTS

JP 55-014283 A 1/1980
JP 2000-263799 A 9/2000
WO WO 99/01284 * 1/1999

* cited by examiner

*Primary Examiner*—Manish Shah
*Assistant Examiner*—Geoffrey Mruk
(74) *Attorney, Agent, or Firm*—Sughrue Mion, PLLC

(57) ABSTRACT

In order to manufacture a liquid ejection apparatus, a metal board is prepared. The metal board is subjected to a plastic working to form a plurality of recesses on a first face in a first region of the metal board. Through holes are punched so as to communicate the recesses and a second face of the metal board. The metal board is subjected to a plastic working to form a plurality of dents in a second region of the meal board. A metallic nozzle plate formed with nozzles is joined onto the second face of the metal board, such that each of the nozzles is communicated with one of the through holes.

15 Claims, 20 Drawing Sheets

LIQUID EJECTION HEAD, AND METHOD OF MANUFACTURING THE SAME

BACKGROUND OF THE INVENTION

The present invention relates to a liquid ejection head in which a chamber formation plate is worked by forging, and to a method of manufacturing such a liquid ejection head.

Forging work is used in various fields of products. For example, it is thought that a pressure generating chamber of a liquid ejection head is molded by forging metal material. The liquid ejection head ejects pressurized liquid from a nozzle orifice as a liquid droplet, and the heads for various liquids have been known. An ink jet recording head is representative of the liquid ejection head. Here, the related art will be described with the ink jet recording head as an example.

An ink jet recording head (hereinafter, referred to as "recording head") used as an example of a liquid ejection head is provided with a plurality of series of flow paths reaching nozzle orifices from a common ink reservoir via pressure generating chambers in correspondence with the orifices. Further, the respective pressure generating chambers need to form by a fine pitch in correspondence with a recording density to meet a request of downsizing. Therefore, a wall thickness of a partition wall for partitioning contiguous ones of the pressure generating chambers is extremely thinned. Further, an ink supply port for communicating the pressure generating chamber and the common ink reservoir is more narrowed than the pressure generating chamber in a flow path width thereof in order to use ink pressure at inside of the pressure generating chamber efficiently for ejection of ink drops.

According to a related-art recording head, a silicon substrate is preferably used in view of fabricating the pressure generating chamber and the ink supply port having such small-sized shapes with excellent dimensional accuracy. That is, a crystal surface is exposed by anisotropic etching of silicon and the pressure generating chamber or the ink supply port is formed to partition by the crystal surface.

Further, a nozzle plate formed with the nozzle orifice is fabricated by a metal board from a request of workability or the like. Further, a diaphragm portion for changing a volume of the pressure generating chamber is formed into an elastic plate. The elastic plate is of a two-layer structure constituted by pasting together a resin film onto a supporting plate made of a metal and is fabricated by removing a portion of the supporting plate in correspondence with the pressure generating chamber. For example, such a structure is disclosed in Japanese Patent Publication No. 2000-263799A.

Meanwhile, according to the above-described related-art recording head, since a difference between linear expansion rates of silicon and the metal is large, in pasting together respective members of the silicon board, the nozzle plate and the elastic plate, it is necessary to adhere the respective members by taking a long time period under relatively low temperature. Therefore, enhancement of productivity is difficult to achieve to bring about a factor of increasing fabrication cost. Therefore, there has been tried to form the pressure generating chamber at the board made of the metal by plastic working, however, the working is difficult since the pressure generating chamber is extremely small and the flow path width of the ink supply port needs to be narrower than the pressure generating chamber to thereby pose a problem that improvement of production efficiency is difficult to achieve.

Under such the circumstances, when the pressure generating chamber is molded by forging work of metal, a problem characteristic of the metal forging work must be solved. The problem is as follows: In a case where a worked shape portion, that is, a groove-shaped recess to be a pressure generating chamber is press-molded, difference in residual stress is produced between a dense worked portion and a sparse worked portion, whereby a strain deformation such as curve or warp is produced in the chamber formation plate. Flatness of the chamber formation plate decreases by this strain deformation, which interferes with bonding of the chamber formation plate to a nozzle plate formed with the nozzle orifice and a sealing plate for sealing the worked pressure generating chamber. Therefore, when the chamber formation plate is assembled as a flow path unit, accuracy in assembly decreases, which may interfere with ejection performance of ink droplet in an extreme case.

SUMMARY OF THE INVENTION

It is therefore an object of the invention to correct strain deformation produced due to difference in residual stress between a worked shaped portion region and another region so that a chamber formation plate having high accuracy can be molded by forging work.

In order to achieve the above object, according to the invention, there is provided a liquid ejection head, comprising:

a metallic chamber formation plate, having a first region in which a plurality of pressure generating chambers are formed, and a second region in which a plurality of dents are formed; and a metallic nozzle plate, formed with a plurality of nozzles, the nozzle plate joined to the chamber formation plate such that each of the nozzles is communicated with one of the pressure generating chambers.

In the first region, since many fine worked portions (pressure generating chambers) are densely arranged, residual stress in this region is relatively high. On the other hand, since in another region than the first region, which has been merely subjected to a rolling work, for example, the residual stress in this region is relatively low. Thus, since there is difference in residual stress between the first region and another region, it is thought that the chamber formation plate shows strain deformation such as curve and warp because of this difference in residual stress.

In the invention, the minute dents are provided in the second region which is the another region as described above. Therefore, when this minute dent is formed, a minute plastic flow is produced on a surface layer of the material metal board. When such minute plastic flow is accumulated, the residual stress is imparted to the second region. Therefore, the residual stress in the first region and the residual stress in the second region are made as uniform as possible, so that the above strain deformation is corrected or prevented. Further, since the second region is pressed throughout a wide range upon molding of the minute dent, the strain deformation is corrected or prevented. Accordingly, a chamber formation plate having high flatness in which the strain deformation does not exist is obtained, and when it is assembled as the flow path unit, a liquid ejection head having high accuracy in assembly is obtained.

Here, the dents are formed on at least one of main faces of the chamber formation plate. In a case where the dents are formed on both of the main faces, the residual stresses with the plastic flows are produced on the both main faces of the chamber formation plate. Therefore, the imparted residual stresses balance with the residual stress in the worked shape portion suitably, so that the occurrence of the strain deformation is surely corrected or prevented.

Here, it is preferable that a position of one of the dents formed on one main face of the chamber formation plate is made coincident with a position of one of the dents formed on the other main face of the chamber formation plate, when viewed from one of the main faces. In this case, the plastic flows are formed by the minute dents in portions of the nearly same arrangement on the both main faces of the chamber formation plate. Therefore, the plastic flows in the chamber formation plate are produced more positively from the both faces, so that the residual stresses with the plastic flows are sufficiently imparted on the both faces of the chamber formation plate without a shortage.

Preferably, each of the dents has a pyramidal shape. In this case, the surface layer of the chamber formation plate shows the plastic flow in the multiple direction by the press-molded minute dent. Therefore, the residual stress is well imparted in the second region.

Alternatively, each of the dents may have a conical shape. In this case, the surface layer of the chamber formation plate shows the plastic flow in all directions. Therefore, residual stress is well imparted in the second region.

Preferably, a size of each of the dents is not greater than a thickness of the chamber formation plate. In this case, since the size of each dent is not so excessive with respect to the plate thickness, a die well bite into the metal board upon molding the dents, so that the plastic flow of material can be produced suitably.

Preferably, each of dents is formed at a portion where is away from the first region by a distance not less than a thickness of the chamber formation plate. In this case, an influence of the plastic flow of material produced by molding of the minute dent is not exerted on the first portion. Therefore, the minute dent does not lower the shape or dimensional accuracy of the pressure generating chambers.

Preferably, the dents are arranged with an interval which is substantially equal to a thickness of the chamber formation plate. In this case, since the interval between the minute dents is not so large as to greatly exceed the plate thickness dimension, the minute plastic flow of the material produced by molding of the minute dent can be well accumulated.

Preferably, the chamber formation plate is comprised of nickel. Since nickel has a relatively low linear expansion rate, thermal deformation degree is not so deviated from that of another parts. Further, nickel is excellent in corrosion resistance, and rich in ductility.

Preferably, the first region is located at a center portion of the chamber formation chamber while being surrounded by the second region. Here, it is preferable that the dents are formed at positions opposed to each other with the first region between. In this case, the relatively large residual stress in the first region located in the central region is balanced by the residual stress imparted by the minute dents formed around the first region, so that the strain deformation of the chamber formation plate is well corrected or prevented with good balance.

Preferably, the pressure generating chamber are arranged with an interval which is not greater than 0.3 mm. In a case where such precise working is required, since the accumulation of the residual stress in the first region becomes large, the effect of the invention which corrects or prevents the strain deformation with the residual stress is remarkable.

Preferably, the first region and the second region are partly overlapped at a third region adjacent to both longitudinal ends of the pressure generating chambers.

In a case where adhesive agent is used to join the chamber formation plate and a sealing plate for sealing the pressure generating chambers, the dents formed in the second region can be used to receive excess adhesive agent so that such excessive agent is prevented from flowing to first region. Even if the excessive agent flows into the first region, the dents formed in the third region surely receive such excessive agent. Accordingly, it is possible to avoid such an inconvenient situation that the excess adhesive agent overflows into the pressure generating chambers to reduce the effective width thereof.

Here, it is preferable that the dents in the third region are arranged with a fixed pitch which is two to five times as great as a pitch of which the pressure generating chamber is arranged side by side.

In this case, the excess adhesive agent is received in the dents in the third region which are provided such that one dent is associated with at least two pressure generating chambers. The adhesive agent flowing into a slender region between adjacent pressure generating chambers can be restricted to a level which involves no substantial problem.

Therefore, it is preferable that the second region is provided with a length which is two to five times as great as a pitch of which the pressure generating chamber is arranged side by side.

According to the invention, there is also provided a method of manufacturing a liquid ejection apparatus, comprising steps of:

providing a metal board;

subjecting the metal board to a plastic working to form a plurality of recesses on a first face in a first region of the metal board;

punching through holes so as to communicate the recesses and a second face of the metal board;

subjecting the metal board to a plastic working to form a plurality of dents in a second region of the meal board;

joining a metallic sealing plate onto the first face of the metal board so as to seal the recesses; and joining a metallic nozzle plate formed with nozzles, onto the second face of the metal board, such that each of the nozzles is communicated with one of the through holes.

Here, the dents are so formed as to extend in a thickness direction of the metal board.

Namely, the minute dents are formed to impart stress on the second region to balance with a residual stress in the first region, so that the strain deformation of the chamber formation plate produced in the plastic working is corrected or prevented.

Preferably, the dents are formed on one of the first face and the second face which has been an inner side of the metal board curved by the plastic working for forming the recesses. In this case, in a surface layer on the inner face side of the curved metal board, a reactional force is produced in a direction where the surface layer is expanded. The curved shape is accordingly corrected to the flat shape. The dents may be formed on both of the first face and the second face.

Preferably, the manufacturing method further comprises a step of polishing the metal board so as to leave the dents thereon, before the sealing plate and the nozzle plate are joined to the metal board. In this case, the residual stress imparted by the minute dents is maintained so that the strain deformation is not produced in the chamber formation plate even after the polishing. Further, improvement of flatness of the chamber formation plate by polishing makes good bondability to the other member, for example, the nozzle plate. Further, since the minute dents remain, extra adhesive is housed in the minute dents. The adhesive does not flow to the outside, and the layer thickness of the adhesive does not become uneven, so that a liquid ejection head having good accuracy in assembly is obtained.

Preferably, the metal board and the sealing plate are joined with adhesive agent, while excess adhesive agent is received by the dents. In this case, the adhesive agent does not overflow to the outside, and the layer thickness of the adhesive layer will not become uneven, so that a liquid ejection head having good accuracy in assembly is obtained.

Here, it is preferable that the first region and the second region are so arranged as to partly overlap at a third region adjacent to both longitudinal ends of the recesses.

In this case, even if the excessive agent flows into the first region, the dents formed in the third region surely receive such excessive agent. Accordingly, it is possible to avoid such an inconvenient situation that the excess adhesive agent overflows into the pressure generating chambers to reduce the effective width thereof.

It is also preferable that the dents are formed such that a polished amount in the first region and a polished amount of the second region are made identical.

In this case, a thickness of the chamber formation plate obtained after the polishing can be made uniform over the whole region. Accordingly, a man hour of remedy polishing can be reduced, which is effective for reducing a manufacturing cost and shortening a time required for the polishing.

Preferably, the plastic working for forming the dents are performed before the plastic working for forming the recesses.

In this case, the dimensional accuracy of the recesses to be pressure generating chambers can be secured without being influenced by the plastic working for forming the dents.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Embodiments of the invention will be described below with reference to the accompanying drawings. Firstly, the constitution of a liquid ejection head will be described.

Since it is preferable to apply the invention to a recording head of an ink jet recording apparatus, as an example representative of the liquid ejection head, the above recording head is shown in the embodiment.

Figure 1:
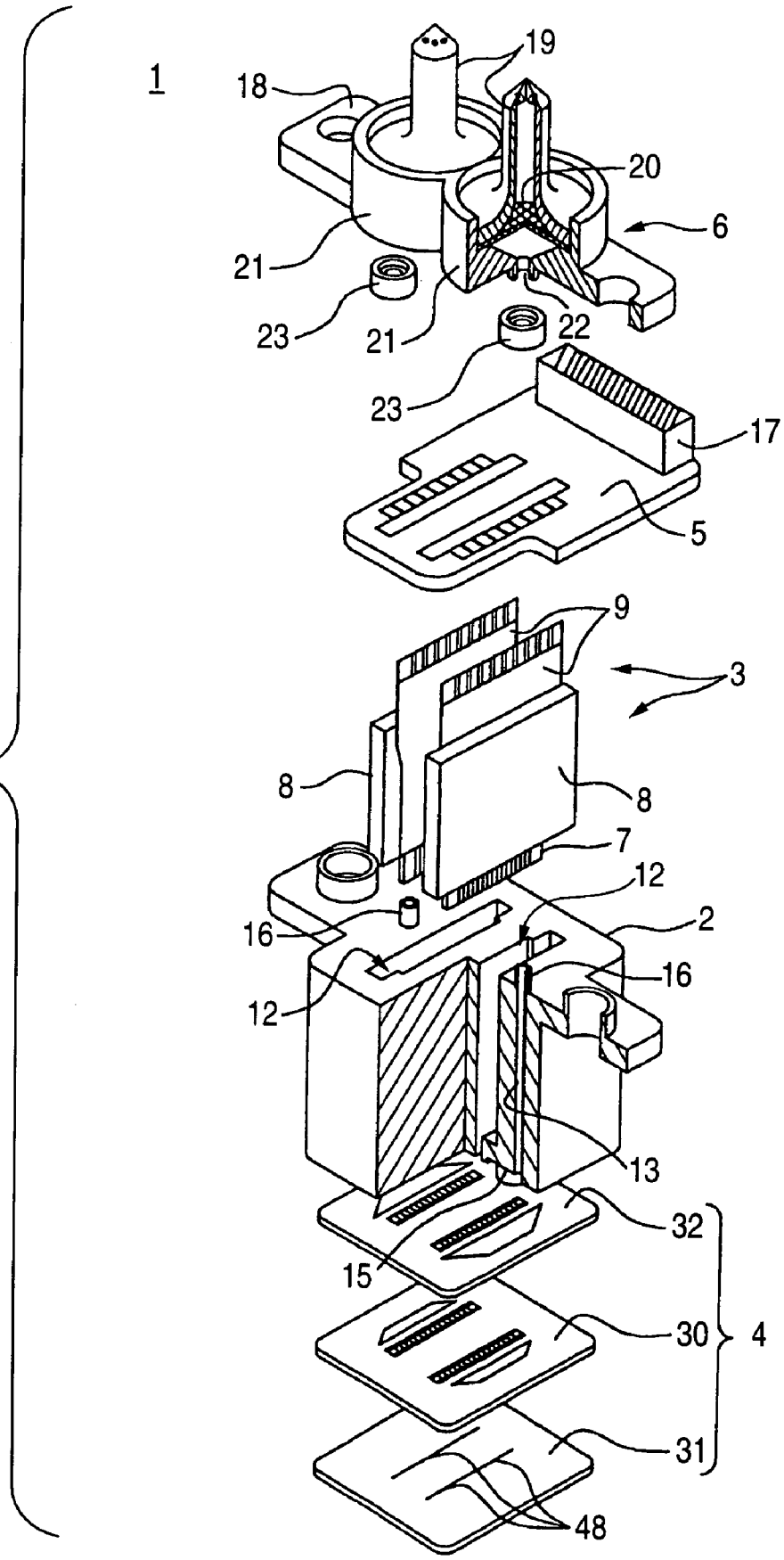
FIG. 1 is a perspective view of a disassembled ink jet recording head according to a first example.
Figure 2:
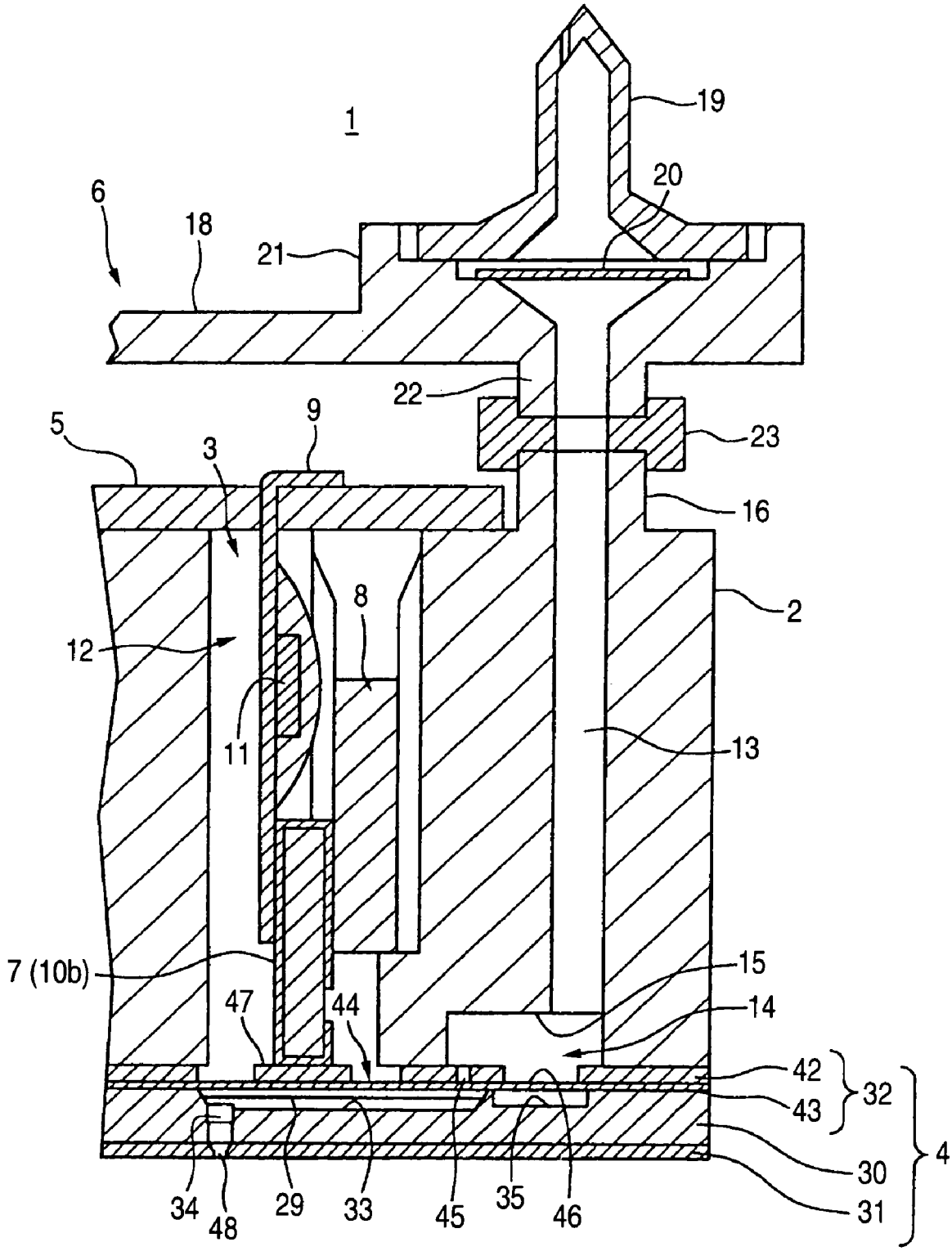
FIG. 2 is a sectional view of the ink jet recording head.

As shown in FIGS. 1 and 2, a recording head 1 is roughly constituted by a casing 2, a vibrator unit 3 contained at inside of the casing 2, a flow path unit 4 bonded to a front end face of the casing 2, a connection board 5 arranged onto a rear end face of the casing 2, a supply needle unit 6 attached to the rear end face of the casing 2.

Figure 3A:
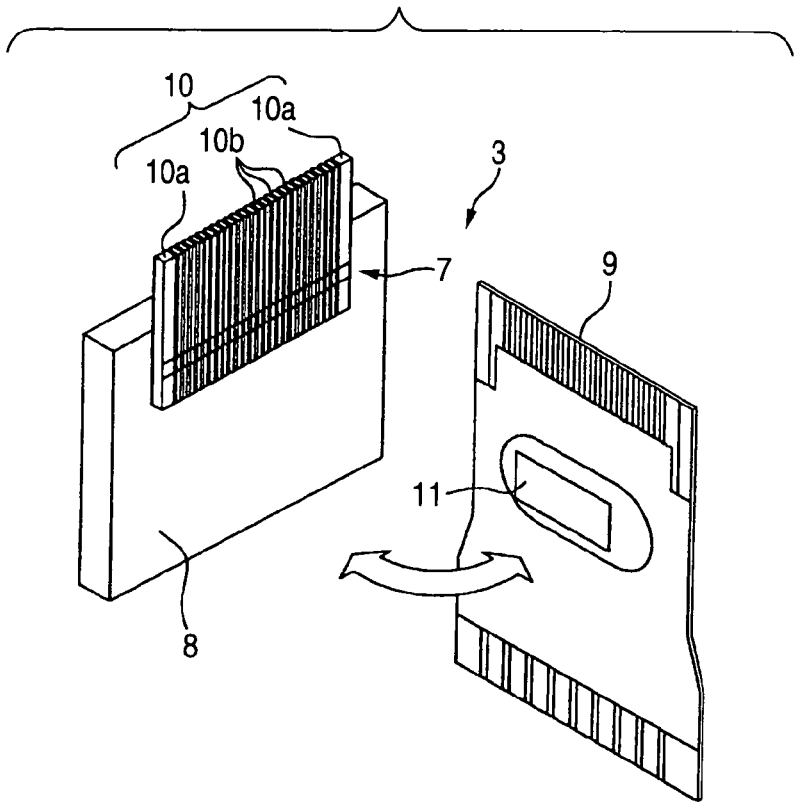
FIGS. 3A and 3B are views for explaining a vibrator unit.
Figure 3B:
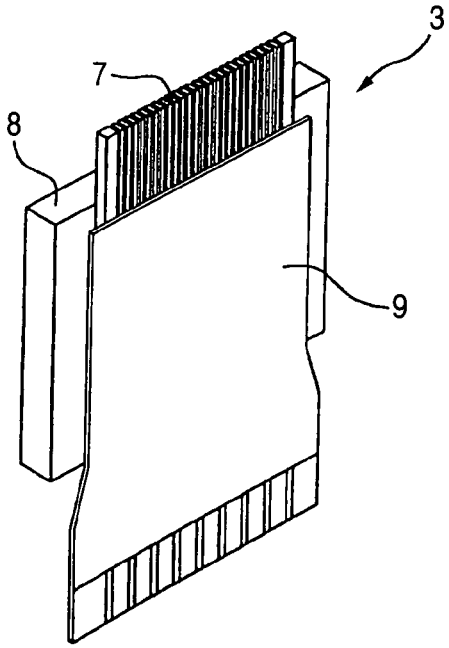

As shown in FIGS. 3A and 3B, the vibrator unit 3 is roughly constituted by a piezoelectric vibrator group 7, a fixation plate 8 bonded with the piezoelectric vibrator group 7 and a flexible cable 9 for supplying a drive signal to the piezoelectric vibrator group 7.

The piezoelectric vibrator group 7 is provided with a plurality of piezoelectric vibrators 10 formed in a shape of a row. The respective piezoelectric vibrators 10 are constituted by a pair of dummy vibrators 10*a* disposed at both ends of the row and a plurality of drive vibrators 10*b* arranged between the dummy vibrators 10*a*. Further, the respective drive vibrators 10*b* are cut to divide in a pectinated shape having an extremely slender width of, for example, about 50 μm through 100 μm, so that 180 pieces are provided.

Further, the dummy vibrator 10*a* is provided with a width sufficiently wider than that of the drive vibrator 10*b* and is provided with a function for protecting the drive vibrator 10*b* against impact or the like and a guiding function for positioning the vibrator unit 3 at a predetermined position.

A free end portion of each of the piezoelectric vibrators 10 is projected to an outer side of a front end face of the fixation plate 8 by bonding a fixed end portion thereof onto the fixation plate 8. That is, each of the piezoelectric vibrators 10 is supported on the fixation plate 8 in a cantilevered manner. Further, the free end portions of the respective piezoelectric vibrators 10 are constituted by alternately laminating piezoelectric bodies and inner electrodes so that extended and contracted in a longitudinal direction of the elements by applying a potential difference between the electrodes opposed to each other.

The flexible cable 9 is electrically connected to the piezoelectric vibrator 10 at a side face of a fixed end portion thereof constituting a side opposed to the fixation plate 8. Further, a surface of the flexible cable 9 is mounted with an IC 11 for controlling to drive the piezoelectric vibrator 10 or the like. Further, the fixation plate 8 for supporting the respective piezoelectric vibrators 10 is a plate-like member having a rigidity capable of receiving reaction force from the piezoelectric vibrators 10, and a metal plate of a stainless steel plate or the like is preferably used therefor.

The casing 2 is a block-like member molded by a thermosetting resin of an epoxy species resin or the like. Here, the casing 2 is molded by the thermosetting resin because the thermosetting resin is provided with a mechanical strength higher than that of a normal resin, a linear expansion coefficient is smaller than that of a normal resin so that deformability depending on the environmental temperature is small. Further, inside of the casing 2 is formed with a container chamber 12 capable of containing the vibrator unit 3, and an ink supply path 13 constituting a portion of a flow path of ink. Further, the front end face of the casing 2 is formed with a recess 15 for constituting a common ink reservoir 14.

The container chamber 12 is a hollow portion having a size of capable of containing the vibrator unit 3. At a portion of a front end side of the container chamber 12, a step portion is formed such that a front end face of the fixation plate 8 is brought into contact therewith.

The recess 15 is formed by partially recessing the front end face of the casing 2 so has to have a substantially trapezoidal shape formed at left and right outer sides of the container chamber 12.

The ink supply path 13 is formed to penetrate the casing 2 in a height direction thereof so that a front end thereof communicates with the recess 15. Further, a rear end portion of the ink supply path 13 is formed at inside of a connecting port 16 projected from the rear end face of the casing 2.

The connection board 5 is a wiring board formed with electric wirings for various signals supplied to the recording head 1 and provided with a connector 17 capable of connecting a signal cable. Further, the connection board 5 is arranged on the rear end face of the casing 2 and connected with electric wirings of the flexible cable 9 by soldering or the like. Further, the connector 17 is inserted with a front end of a signal cable from a control apparatus (not illustrated).

The supply needle unit 6 is a portion connected with an ink cartridge (not illustrated) and is roughly constituted by a needle holder 18, an ink supply needle 19 and a filter 20.

The ink supply needle 19 is a portion inserted into the ink cartridge for introducing ink stored in the ink cartridge. A distal end portion of the ink supply needle 19 is sharpened in a conical shape to facilitate to insert into the ink cartridge. Further, the distal end portion is bored with a plurality of ink introducing holes for communicating inside and outside of the ink supply needle 19. Further, since the recording head according to the embodiment can eject two kinds of inks, two pieces of the ink supply needles 19 are provided.

The needle holder 18 is a member for attaching the ink supply needle 19, and a surface thereof is formed with base seats 21 for two pieces of the ink supply needles 19 for fixedly attaching proximal portions of the ink supply needles 19. The base seat 21 is fabricated in a circular shape in compliance with a shape of a bottom face of the ink supply needle 19. Further, a substantially central portion of the bottom face of the base seat is formed with an ink discharge port 22 penetrated in a plate thickness direction of the needle holder 18. Further, the needle holder 18 is extended with a flange portion in a side direction.

The filter 20 is a member for hampering foreign matters at inside of ink such as dust, burr in dieing and the like from passing therethrough and is constituted by, for example, a metal net having a fine mesh. The filter 20 is adhered to a filter holding groove formed at inside of the base seat 21.

Further, as shown in FIG. 2, the supply needle unit 6 is arranged on the rear end face of the casing 2. In the arranging state, the ink discharge port 22 of the supply needle unit 6 and the connecting port 16 of the casing 2 are communicated with each other in a liquid tight state via a packing 23.

Next, the above-described flow path unit 4 will be explained. The flow path unit 4 is constructed by a constitution in which a nozzle plate 31 is bonded to one face of a chamber formation plate 30 and an elastic plate 32 is bonded to other face of the chamber formation plate 30.

Figure 4:
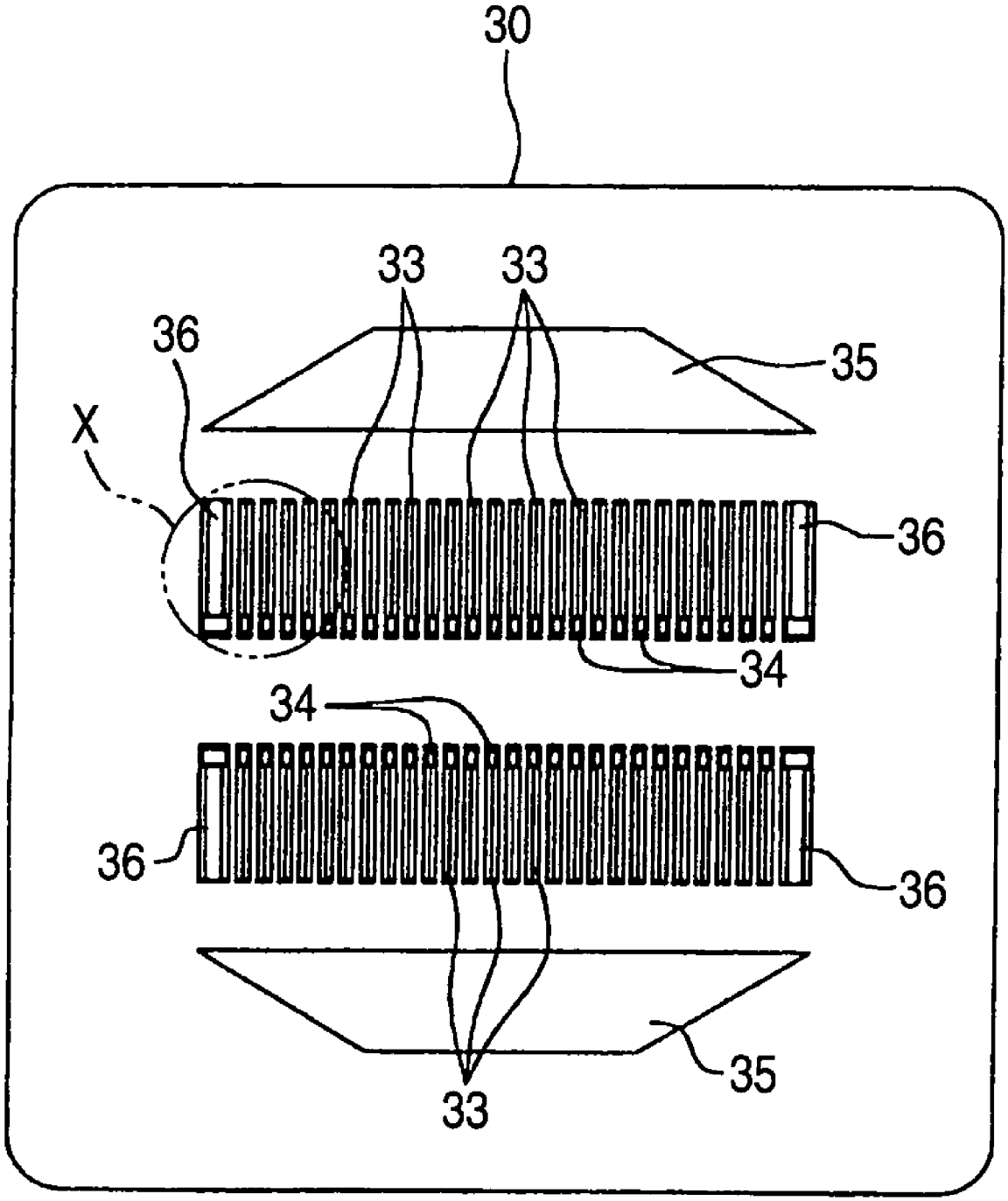
FIG. 4 is a plan view for explaining a chamber formation plate.

As shown in FIG. 4, the chamber formation plate 30 is a plate-like member made of a metal formed with an elongated recess portion 33, a communicating port 34 and an escaping recess portion 35. According to the embodiment, the chamber formation plate 30 is fabricated by working a metal substrate made of nickel having a thickness of 0.35 mm.

An explanation will be given here of reason of selecting nickel of the metal substrate. First reason is that the linear expansion coefficient of nickel is substantially equal to a linear expansion coefficient of a metal (stainless steel in the embodiment as mentioned later) constituting essential portions of the nozzle plate 31 and the elastic plate 32. That is, when the linear expansion coefficients of the chamber formation plate 30, the elastic plate 32 and the nozzle plate 31 constituting the flow path unit 4 are substantially equal, in heating and adhering the respective members, the respective members are uniformly expanded.

Therefore, mechanical stress of warping or the like caused by a difference in the expansion rates is difficult to generate. As a result, even when the adhering temperature is set to high temperature, the respective members can be adhered to each other without trouble. Further, even when the piezoelectric vibrator 10 generates heat in operating the recording head 1 and the flow path unit 4 is heated by the heat, the respective members 30, 31 and 32 constituting the flow path unit 4 are uniformly expanded. Therefore, even when heating accompanied by activating the recording head 1 and cooling accompanied by deactivating are repeatedly carried out, a drawback of exfoliation or the like is difficult to be brought about in the respective members 30, 31 and 32 constituting the flow path unit 4.

Second reason is that nickel is excellent in corrosion resistance. That is, aqueous ink is preferably used in the recording head 1 of this kind, it is important that alteration of rust or the like is not brought about even when the recording head 1 is brought into contact with water over a long time period. In this respect, nickel is excellent in corrosion resistance similar to stainless steel and alteration of rust or the like is difficult to be brought about.

Third reason is that nickel is rich in ductility. That is, in manufacturing the chamber formation plate 30, as mentioned later, the fabrication is carried out by plastic working (for example, forging). Further, the elongated recess portion 33 and the communicating port 34 formed in the chamber formation plate 30 are of extremely small shapes and high dimensional accuracy is requested therefor. When nickel is used for the metal substrate, since nickel is rich in ductility, the elongated recess portion 33 and the communicating port 34 can be formed with high dimensional accuracy even by plastic working.

Further, with regard to the chamber formation plate 30, the chamber formation plate 30 may be constituted by a metal other than nickel when the condition of the linear expansion coefficient, the condition of the corrosion resistance and the condition of the ductility are satisfied.

Figure 5A:
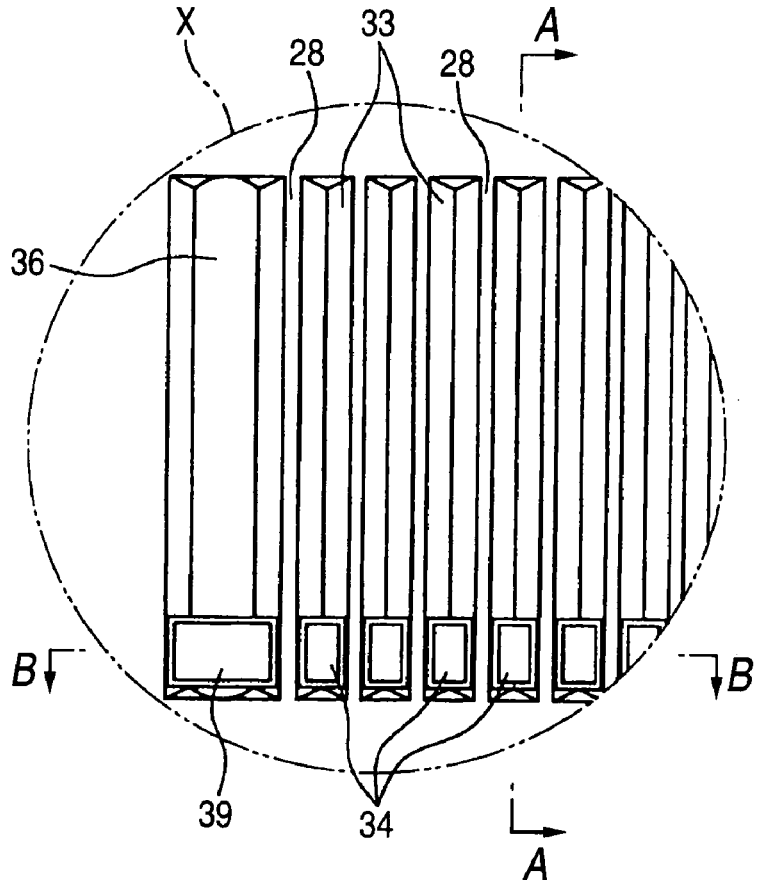
FIG. 5A is a view enlarging an X portion in FIG. 4.
Figure 5B:
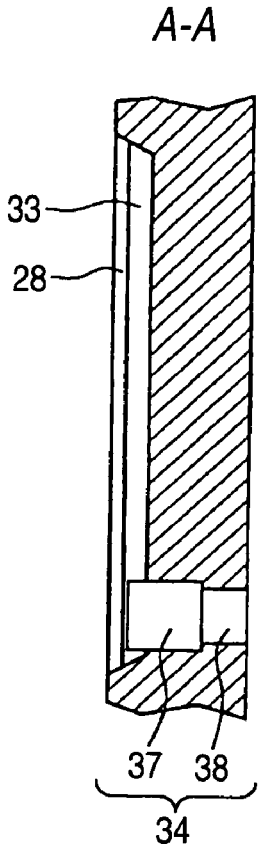
FIG. 5B is a sectional view taken along a line A—A of FIG. 5A.
Figure 5C:
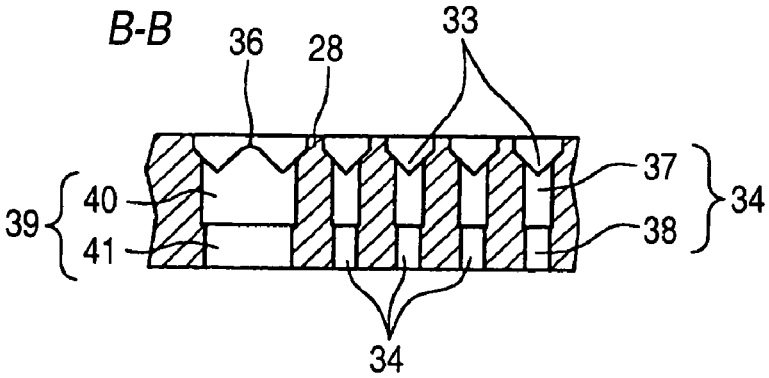
FIG. 5C is a sectional view taken along a line B—B of FIG. 5A.

The elongated recess portion 33 is a recess portion in a groove-like shape constituting a pressure generating chamber 29 and is constituted by a groove in a linear shape as shown to enlarge in FIG. 5A. According to the embodiment, 180 pieces of grooves each having a width of about 0.1 mm, a length of about 1.5 mm and a depth of about 0.1 mm are aligned side by side. A bottom face of the elongated recess portion 33 is recessed in a V-like shape by reducing a width thereof as progressing in a depth direction (that is, depth side). The bottom face is recessed in the V-like shape to increase a rigidity of a partition wall 28 for partitioning the contiguous pressure generating chambers 29. That is, by recessing the bottom face in the V-like shape, a wall thickness of the proximal portion of the partition wall 28 is thickened to increase the rigidity of the partition wall 28. Further, when the rigidity of the partition wall 28 is increased, influence of pressure variation from the contiguous pressure generating chamber 29 is difficult to be effected. That is, a variation of ink pressure from the contiguous pressure generating chamber 29 is difficult to transmit. Further, by recessing the bottom face in the V-like shape, the elongated recess portion 33 can be formed with excellent dimensional accuracy by plastic working (to be mentioned later). Further, an angle between the inner faces of the recess portion 33 is, for example, around 90 degrees although prescribed by a working condition.

Further, since a wall thickness of a distal end portion of the partitioning wall 28 is extremely thin, even when the respective pressure generating chambers 29 are densely formed, a necessary volume can be ensured.

Both longitudinal end portions of the elongated recess portion 33 are sloped downwardly to inner sides as progressing to the depth side. The both end portions are constituted in this way to form the elongated recess portion 33 with excellent dimensional accuracy by plastic working.

Further, contiguous to the elongated recess portion 33 at the both ends of the row, there are formed single ones of dummy recesses 36 having a width wider than that of the elongated recess portion 33. The dummy recess portion 36 is a recess portion in a groove-like shape constituting a dummy pressure generating chamber which is not related to ejection of ink drops. The dummy recess portion 36 according to the embodiment is constituted by a groove having a width of about 0.2 mm, a length of about 1.5 mm and a depth of about 0.1 mm. Further, a bottom face of the dummy recess portion 36 is recessed in a W-like shape. This is also for increasing the rigidity of the partition wall 28 and forming the dummy recess portion 36 with excellent dimensional accuracy by plastic working.

Further, a row of recesses is constituted by the respective elongated recess portions 33 and the pair of dummy recess portions 36. According to the embodiment, two rows of the recesses are formed as shown in FIG. 4.

The communicating port 34 is formed as a small through hole penetrating from one end of the elongated recess portion 33 in a plate thickness direction. The communicating ports 34 are formed for respective ones of the elongated recess portions 33 and are formed by 180 pieces in a single recess portion row. The communicating port 34 of the embodiment is in a rectangular shape in an opening shape thereof and is constituted by a first communicating port 37 formed from a side of the elongated recess portion 33 to a middle in the plate thickness direction in the chamber formation plate 30 and a second communicating port 38 formed from a surface thereof on a side opposed to the elongated recess portion 33 up to a middle in the plate thickness direction.

Further, sectional areas of the first communicating port 37 and the second communicating port 38 differ from each other and an inner dimension of the second communicating port 38 is set to be slightly smaller than an inner dimension of the first communicating port 37. This is caused by manufacturing the communicating port 34 by pressing. The chamber formation plate 30 is fabricated by working a nickel plate having a thickness of 0.35 mm, a length of the communicating port 34 becomes equal to or larger than 0.25 mm even when the depth of the recess portion 33 is subtracted. Further, the width of the communicating port 34 needs to be narrower than the groove width of the elongated recess portion 33, set to be less than 0.1 mm. Therefore, when the communicating port 34 is going to be punched through by a single time of working, a male die (punch) is buckled due to an aspect ratio thereof.

Therefore, in the embodiment, the working is divided into two steps. In the first step, the first communicating port 37 is formed halfway in the plate thickness direction, and in the second step, the second communicating port 38 is formed. The working process of this communicating port 34 will be described later.

Further, the dummy recess portion 36 is formed with a dummy communicating port 39. Similar to the above-described communicating port 34, the dummy communicating port 39 is constituted by a first dummy communicating port 40 and a second dummy communicating port 41 and an inner dimension of the second dummy communicating port 41 is set to be smaller than an inner dimension of the first dummy communicating port 40.

Further, although according to the embodiment, the communicating port 34 and the dummy communicating port 39 opening shapes of which are constituted by small through holes in a rectangular shape are exemplified, the invention is not limited to the shape. For example, the shape may be constituted by a through hole opened in a circular shape or a through hole opened in a polygonal shape.

The escaping recess portion 35 forms an operating space of a compliance portion 46 (described later) in the common ink reservoir 14. According to the embodiment, the escaping recess portion 35 is constituted by a recess portion in a trapezoidal shape having a shape substantially the same as that of the recess 15 of the casing 2 and a depth equal to that of the elongated recess portion 33.

Next, the above-described elastic plate 32 will be explained. The elastic plate 32 is a kind of a sealing plate of the invention and is fabricated by, for example, a composite material having a two-layer structure laminating an elastic film 43 on a support plate 42. According to the embodiment, a stainless steel plate is used as the support plate 42 and PPS (polyphenylene sulphide) is used as the elastic film 43.

Figure 6:
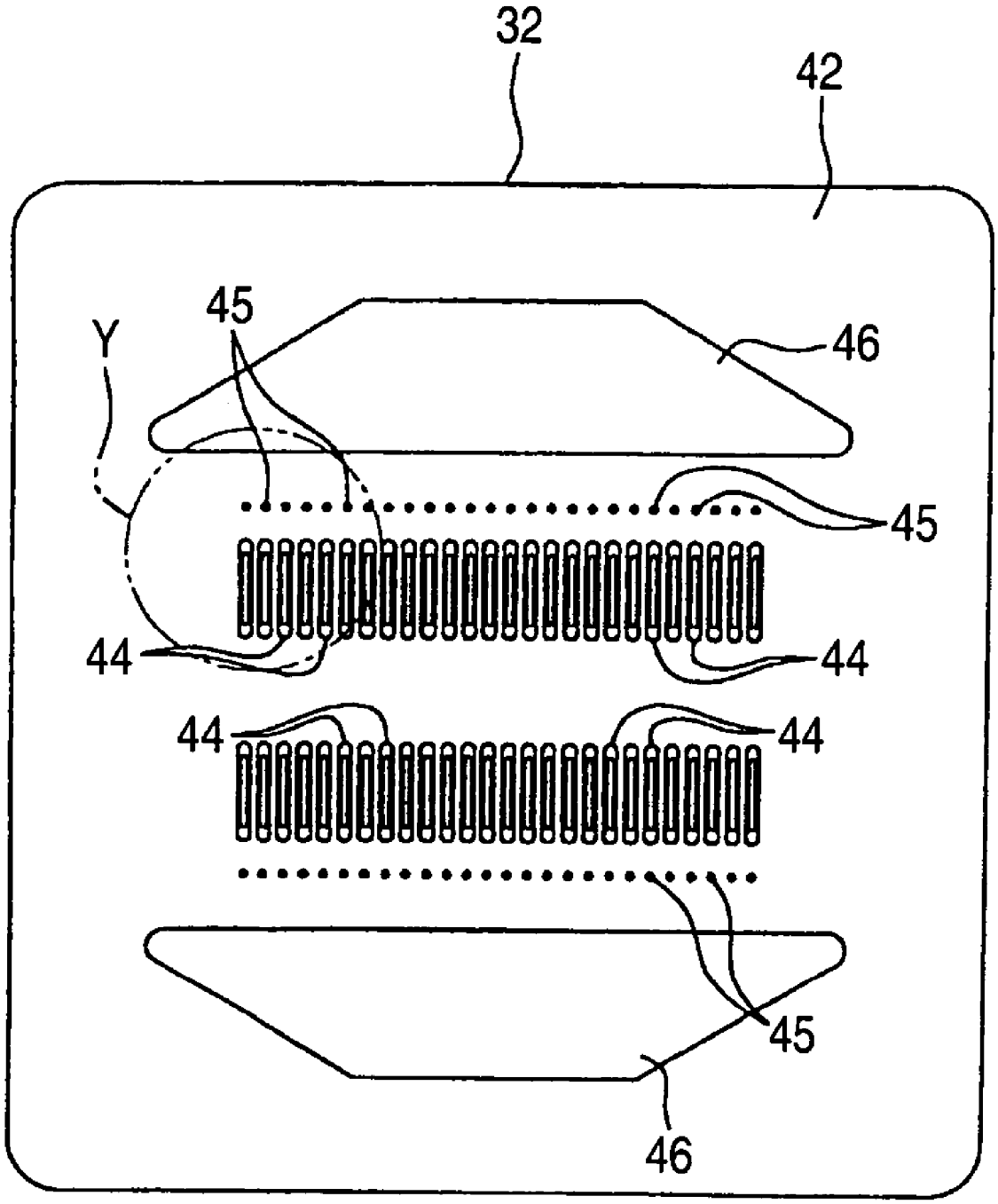
FIG. 6 is a plan view of an elastic plate.

As shown in FIG. 6, the elastic plate 32 is formed with a diaphragm portion 44, an ink supply port 45 and the compliance portion 46.

The diaphragm portion 44 is a portion for partitioning a portion of the pressure generating chamber 29. That is, the diaphragm portion 44 seals an opening face of the elongated recess portion 33 and forms to partition the pressure generating chamber 29 along with the elongated recess portion 33. As shown in FIG. 7A, the diaphragm portion 44 is of a slender shape in correspondence with the elongated recess portion 33 and is formed for each of the elongated recess portions 33 with respect to a sealing region for sealing the elongated recess portion 33. Specifically, a width of the diaphragm portion 44 is set to be substantially equal to the groove width of the elongated recess portion 33 and a length of the diaphragm portion 44 is set to be a slight shorter than the length of the elongated recess portion 33. With regard to the length, the length is set to be about two thirds of the length of the elongated recess portion 33. Further, with regard to a position of forming the diaphragm portion 44, as shown in FIG. 2, one end of the diaphragm portion 44 is aligned to one end of the elongated recess portion 33 (end portion on a side of the communicating port 34).

Figure 7B:
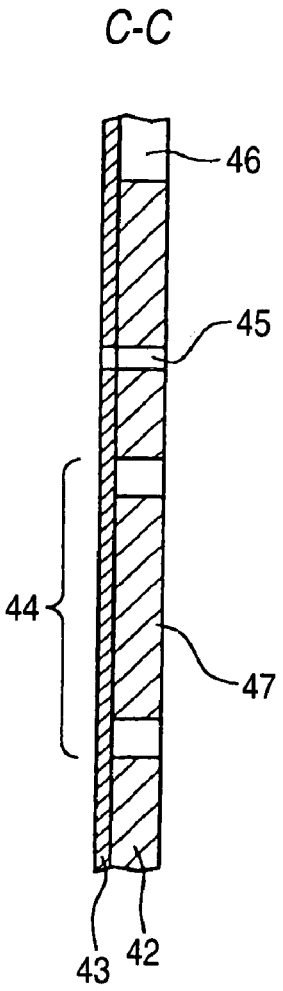
FIG. 7B is a sectional view taken along a line C—C of FIG. 7A.
Figure 7A:
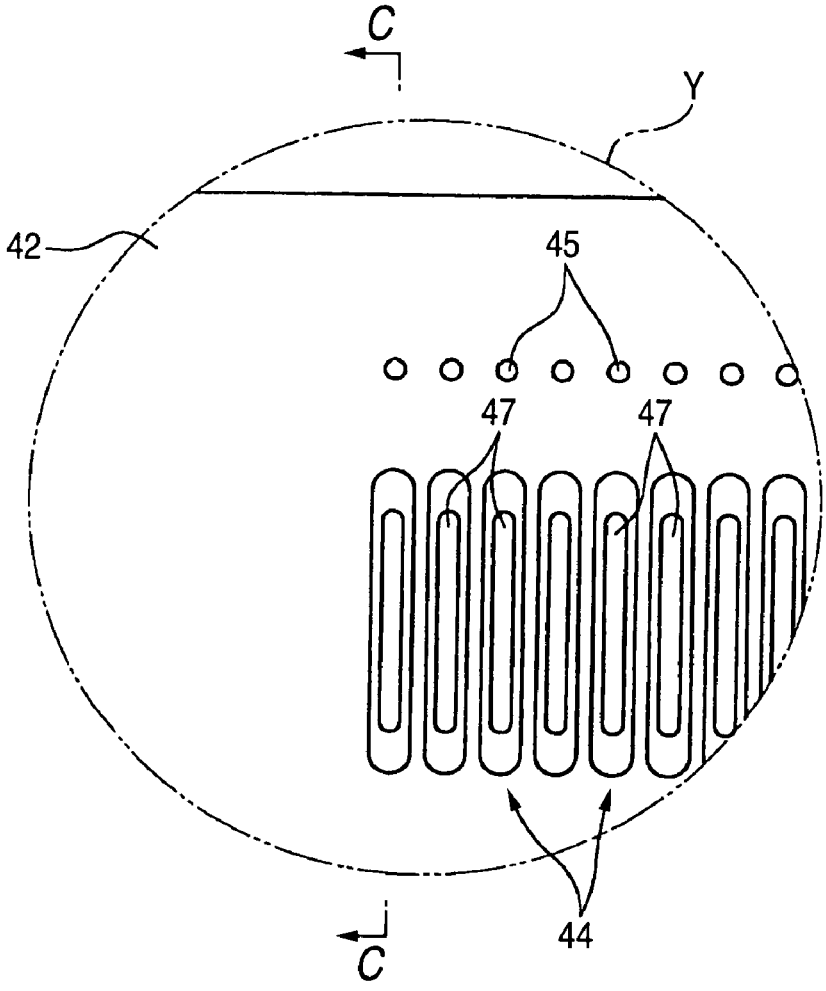
FIG. 7A is a view enlarging a Y portion of FIG. 6.

As shown in FIG. 7B, the diaphragm portion 44 is fabricated by removing the support plate 42 at a portion thereof in correspondence with the elongated recess portion 33 by etching or the like to constitute only the elastic film 43 and an island portion 47 is formed at inside of the ring. The island portion 47 is a portion bonded with a distal end face of the piezoelectric vibrator 10.

The ink supply port 45 is a hole for communicating the pressure generating chamber 29 and the common ink reservoir 14 and is penetrated in a plate thickness direction of the elastic plate 32. Similar to the diaphragm portion 44, also the ink supply port 45 is formed to each of the elongated recess portions 33 at a position in correspondence with the elongated recess portion 33. As shown in FIG. 2, the ink supply port 45 is bored at a position in correspondence with other end of the elongated recess portion 33 on a side opposed to the communicating port 34. Further, a diameter of the ink supply port 45 is set to be sufficiently smaller than the groove width of the elongated recess portion 33. According to the embodiment, the ink supply port 45 is constituted by a small through hole of 23 μm.

Reason of constituting the ink supply port 45 by the small through hole in this way is that flow path resistance is provided between the pressure generating chamber 29 and the common ink reservoir 14. That is, according to the recording head 1, an ink drop is ejected by utilizing a pressure variation applied to ink at inside of the pressure generating chamber 29. Therefore, in order to efficiently eject an ink drop, it is important that ink pressure at inside of the pressure generating chamber 29 is prevented from being escaped to a side of the common ink reservoir 14 as less as possible. From the view point, the ink supply port 45 is constituted by the small through hole.

Further, when the ink supply port 45 is constituted by the through hole as in the embodiment, there is an advantage that the working is facilitated and high dimensional accuracy is achieved. That is, the ink supply port 45 is the through hole, can be fabricated by laser machining. Therefore, even a small diameter can be fabricated with high dimensional accuracy and also the operation is facilitated.

The compliance portion 46 is a portion for partitioning a portion of the common ink reservoir 14. That is, the common ink reservoir 14 is formed to partition by the compliance portion 46 and the recess 15. The compliance portion 46 is of a trapezoidal shape substantially the same as an opening shape of the recess 15 and is fabricated by removing a portion of the support plate 42 by etching or the like to constitute only the elastic film 43.

Further, the support plate 42 and the elastic film 43 constituting the elastic plate 32 are not limited to the example. Further, polyimide may be used as the elastic film 43. Further, the elastic plate 32 may be constituted by a metal plate provided with a thick wall and a thin wall at a surrounding of the thick wall for constituting the diaphragm portion 44 and a thin wall for constituting the compliance portion 46.

Next, the above-described nozzle plate 31 will be explained. The nozzle plate 31 is a plate-like member made of a metal aligned with a plurality of nozzle orifices 48 at a pitch in correspondence with a dot forming density. According to the embodiment, a nozzle row is constituted by aligning a total of 180 pieces of the nozzle orifices 48 and two rows of the nozzles are formed as shown in FIG. 2.

Further, when the nozzle plate 31 is bonded to other face of the chamber formation plate 30, that is, to a surface thereof on a side opposed to the elastic plate 32, the respective nozzle orifices 48 face the corresponding communicating ports 34.

Further, when the above-described elastic plate 32 is bonded to one surface of the chamber formation plate 30, that is, a face thereof for forming the elongated recess portion 33, the diaphragm portion 44 seals the opening face of the elongated recess portion 33 to form to partition the pressure generating chamber 29. Similarly, also the opening face of the dummy recess portion 36 is sealed to form to partition the dummy pressure generating chamber. Further, when the above-described nozzle plate 31 is bonded to other surface of the chamber formation plate 30, the nozzle orifice 48 faces the corresponding communicating port 34. When the piezoelectric vibrator 10 bonded to the island portion 47 is extended or contracted under the state, the elastic film 43 at a surrounding of the island portion is deformed and the island portion 47 is pushed to the side of the elongated recess portion 33 or pulled in a direction of separating from the side of the elongated recess portion 33. By deforming the elastic film 43, the pressure generating chamber 29 is expanded or contracted to provide a pressure variation to ink at inside of the pressure generating chamber 29.

When the elastic plate 32 (that is, the flow path unit 4) is bonded to the casing 2, the compliance portion 46 seals the recess 15. The compliance portion 46 absorbs the pressure variation of ink stored in the common ink reservoir 14. That is, the elastic film 43 is deformed in accordance with pressure of stored ink. Further, the above-described escaping recess portion 35 forms a space for allowing the elastic film 43 to be expanded.

The recording head 1 having the above-described constitution includes a common ink flow path from the ink supply needle 19 to the common ink reservoir 14, and an individual ink flow path reaching each of the nozzle orifices 48 by passing the pressure generating chamber 29 from the common ink reservoir 14. Further, ink stored in the ink cartridge is introduced from the ink supply needle 19 and stored in the common ink reservoir 14 by passing the common ink flow path. Ink stored in the common ink reservoir 14 is ejected from the nozzle orifice 48 by passing the individual ink flow path.

For example, when the piezoelectric vibrator 10 is contracted, the diaphragm portion 44 is pulled to the side of the vibrator unit 3 to expand the pressure generating chamber 29. By the expansion, inside of the pressure generating chamber 29 is brought under negative pressure, ink at inside of the common ink reservoir 14 flows into each pressure generating chamber 29 by passing the ink supply port 45. Thereafter, when the piezoelectric vibrator 10 is extended, the diaphragm portion 44 is pushed to the side of the chamber formation plate 30 to contract the pressure generating chamber 29. By the contraction, ink pressure at inside of the pressure generating chamber 29 rises and an ink drop is ejected from the corresponding nozzle orifice 48.

According to the recording head 1, the bottom face of the pressure generating chamber 29 (elongated recess portion 33) is recessed in the V-like shape. Therefore, the wall thickness of the proximal portion of the partition wall 28 for partitioning the contiguous pressure generating chambers 29 is formed to be thicker than the wall thickness of the distal end portion. Thereby, the rigidity of the thick wall 28 can be increased. Therefore, in ejecting an ink drop, even when a variation of ink pressure is produced at inside of the pressure generating chamber 29, the pressure variation can be made to be difficult to transmit to the contiguous pressure generating chamber 29. As a result, the so-called contiguous cross talk can be prevented and ejection of ink drop can be stabilized.

According to the embodiment, the ink supply port 45 for communicating the common ink reservoir 14 and the pressure generating chamber 29 is constituted by the small hole penetrating the elastic plate 32 in the plate thickness direction, high dimensional accuracy thereof is easily achieved by laser machining or the like. Thereby, an ink flowing characteristic into the respective pressure generating chambers 29 (flowing velocity, flowing amount or the like) can be highly equalized. Further, when the fabrication is carried out by the laser beam, the fabrication is also facilitated.

According to the embodiment, there are provided the dummy pressure generating chambers which are not related to ejection of ink drop contiguously to the pressure generating chambers 29 at end portions of the row (that is, a hollow portion partitioned by the dummy recess portion 36 and the elastic plate 32), with regard to the pressure generating chambers 29 at both ends, one side thereof is formed with the contiguous pressure generating chamber 29 and an opposed thereof is formed with the dummy pressure generating chamber. Thereby, with regard to the pressure generating chambers 29 at end portions of the row, the rigidity of the partition wall partitioning the pressure generating chamber 29 can be made to be equal to the rigidity of the partition wall at the other pressure generating chambers 29 at a middle of the row. As a result, ink drop ejection characteristics of all the pressure generating chambers 29 of the one row can be made to be equal to each other.

With regard to the dummy pressure generating chamber, the width on the side of the aligning direction is made to be wider than the width of the respective pressure generating chambers 29. In other words, the width of the dummy recess portion 36 is made to be wider than the width of the elongated recess portion 33. Thereby, ejection characteristics of the pressure generating chamber 29 at the end portion of the row and the pressure generating chamber 29 at the middle of the row can be made to be equal to each other with high accuracy.

According to the embodiment, the recess 15 is formed by partially recessing the front end face of the casing 2, the common ink reservoir 14 is formed to partition by the recess 15 and the elastic plate 32, an exclusive member for forming the common ink reservoir 14 is dispensed with and simplification of the constitution is achieved. Further, the casing 2 is fabricated by resin dieing, fabrication of the recess 15 is also relatively facilitated.

Next, a method of manufacturing the recording head 1 will be explained. Since the manufacturing method is characterized in steps of manufacturing the chamber formation plate 30, an explanation will be mainly given for the steps of manufacturing the chamber formation plate 30.

The chamber formation plate 30 is fabricated by forging by a progressive die. Further, a metal strip 55 (referred to as "strip 55" in the following explanation) used as a material of the chamber formation plate 30 is made of nickel as described above.

The steps of manufacturing the chamber formation plate 30 comprises steps of forming the elongated recess portion 33 and steps of forming the communicating port 34 which are carried out by a progressive die.

Figure 8A:
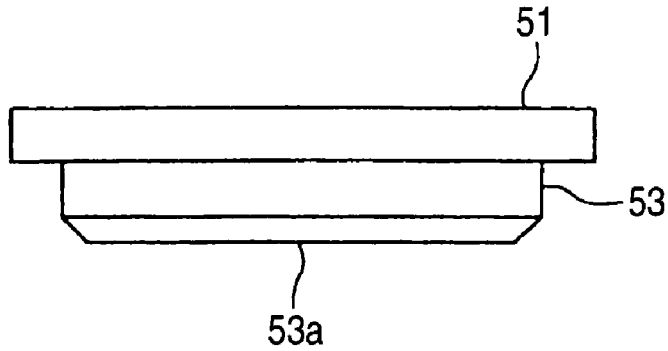
FIGS. 8A and 8B are views for explaining a first male die used in forming an elongated recess portion.
Figure 8B:
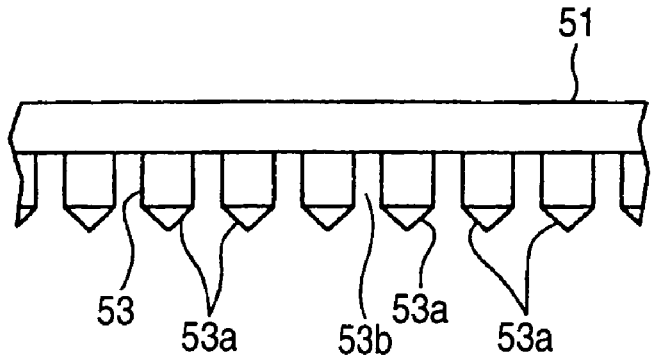
Figure 9A:
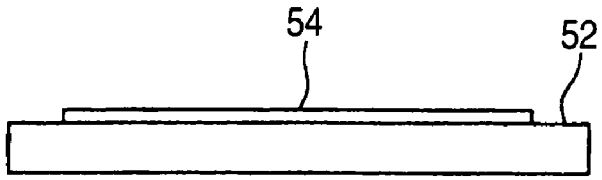
FIGS. 9A and 9B are views for explaining a female die used in forming the elongated recess portion.
Figure 9B:
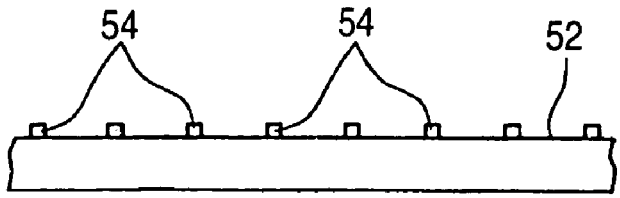

In the elongated recess portion forming steps, a first male die 51 shown in FIGS. 8A and 8B and a female die shown in FIGS. 9A and 9B are used. The first male die 51 is a die for forming the elongated recess portion 33. The male die is aligned with projections 53 for forming the elongated recess portions 33 by a number the same as that of the elongated recess portions 33. Further, the projections 53 at both ends in an aligned direction are also provided with dummy projections (not illustrated) for forming the dummy recess portions 36. A distal end portion 53*a* of the projection 53 is tapered from a center thereof in a width direction by an angle of about 45 degrees as shown in FIG. 8B. Thereby, the distal end portion 53*a* is sharpened in the V-like shape in view from a longitudinal direction thereof. Further, both longitudinal ends of the distal end portions 53A are tapered by an angle of about 45 degrees as shown in FIG. 8A. Therefore, the distal end portion 53*a* of the projection 53 is formed in a shape of tapering both ends of a triangular prism.

Further, the female die 52 is formed with a plurality of projections 54 at an upper face thereof. The projection 54 is for assisting to form the partition wall partitioning the contiguous pressure generating chambers 29 and is disposed between the elongated recess portions 33. The projection 54 is of a quadrangular prism, a width thereof is set to be a slight narrower than an interval between the contiguous pressure generating chambers 29 (thickness of partition wall) and a height thereof is set to a degree the same as that of the width. A length of the projection 54 is set to a degree the same as that of a length of the elongated recess portion 33 (projection 53).

Figure 10A:
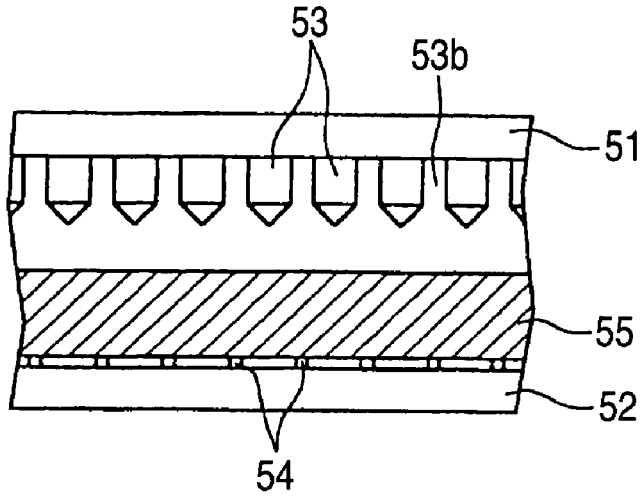
FIGS. 10A to 10C are views for explaining a step of forming the elongated recess portion.
Figure 10B:
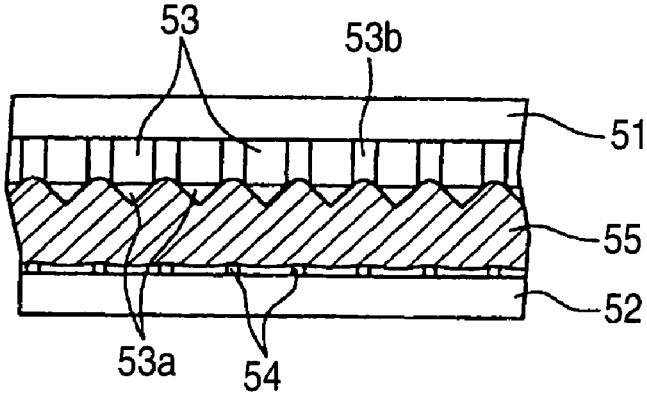
Figure 10C:
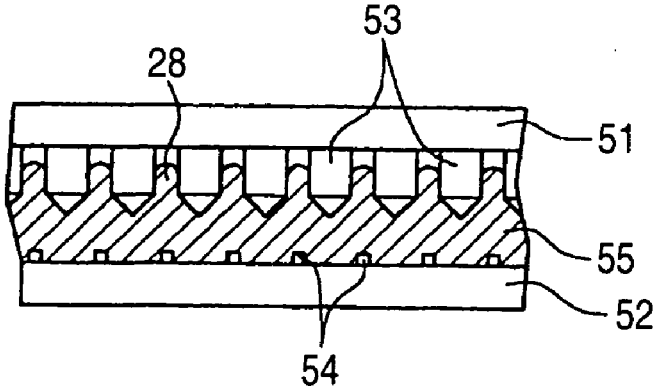

In the elongated recess portion forming steps, first, as shown in FIG. 10A, the strip 55 is mounted at an upper face of the female die 52 and the first male die 51 is arranged on an upper side of the strip 55. Next, as shown in FIG. 10B, the first male die 51 is moved down to push the distal end portion of the projection 53 into the strip 55. At this occasion, since the distal end portion 53*a* of the projection 53 is sharpened in the V-like shape, the distal end portion 53*a* can firmly be pushed into the strip 55 without buckling. Pushing of the projection 53 is carried out up to a middle in a plate thickness direction of the strip 55 as shown in FIG. 10C.

By pushing the projection 53, a portion of the strip 55 flows to form the elongated recess portion 33. In this case, since the distal end portion 53*a* of the projection 53 is sharpened in the V-like shape, even the elongated recess portion 33 having a small shape can be formed with high dimensional accuracy. That is, the portion of the strip 55 pushed by the distal end portion 53*a* flows smoothly, the elongated recess portion 33 to be formed is formed in a shape following the shape of the projection 53. Further, since the both longitudinal ends of the distal end portion 53*a* are tapered, the strip 55 pushed by the portions also flows smoothly. Therefore, also the both end portions in the longitudinal direction of the elongated recess portion 33 are formed with high dimensional accuracy.

Since pushing of the projection 53 is stopped at the middle of the plate thickness direction, the strip 55 thicker than in the case of forming a through hole can be used. Thereby, the rigidity of the chamber formation plate 30 can be increased and improvement of an ink ejection characteristic is achieved. Further, the chamber formation plate 30 is easily dealt with and the operation is advantageous also in enhancing plane accuracy.

A portion of the strip 55 is raised into a space between the contiguous projections 53 by being pressed by the projections 53. In this case, the projection 54 provided at the female die 52 is arranged at a position in correspondence with an interval between the projections 53, flow of the strip 55 into the space is assisted. Thereby, the strip 55 can efficiently be introduced into the space between the projections 53 and the protrusion (i.e., the partition wall 28) can be formed highly.

In the above molding process, it is necessary to correct or prevent strain deformation to manufacture the chamber formation plate 30 with high flatness.

Namely, in a worked shape portion that is a region in which the elongated recess portions are formed, a large number of finely worked portions are densely arranged. Therefore, residual stress in this worked region is relatively high. On the other hand, in another region than the worked region has been merely subjected to a rolling work, for example. Therefore, the residual stress in this region is relatively low. Thus, since there is difference in residual stress between the worked region and another region than it, it is thought that the chamber formation plate shows strain deformation such as curve and warp because of this difference in residual stress.

The configuration for solving the above problem will be described below.

Plastic working is performed on the strip (material) 55 by the male die 51 and the female die 52 under condition of room temperature, and plastic working described below is performed similarly under condition of room temperature.

Figure 11:
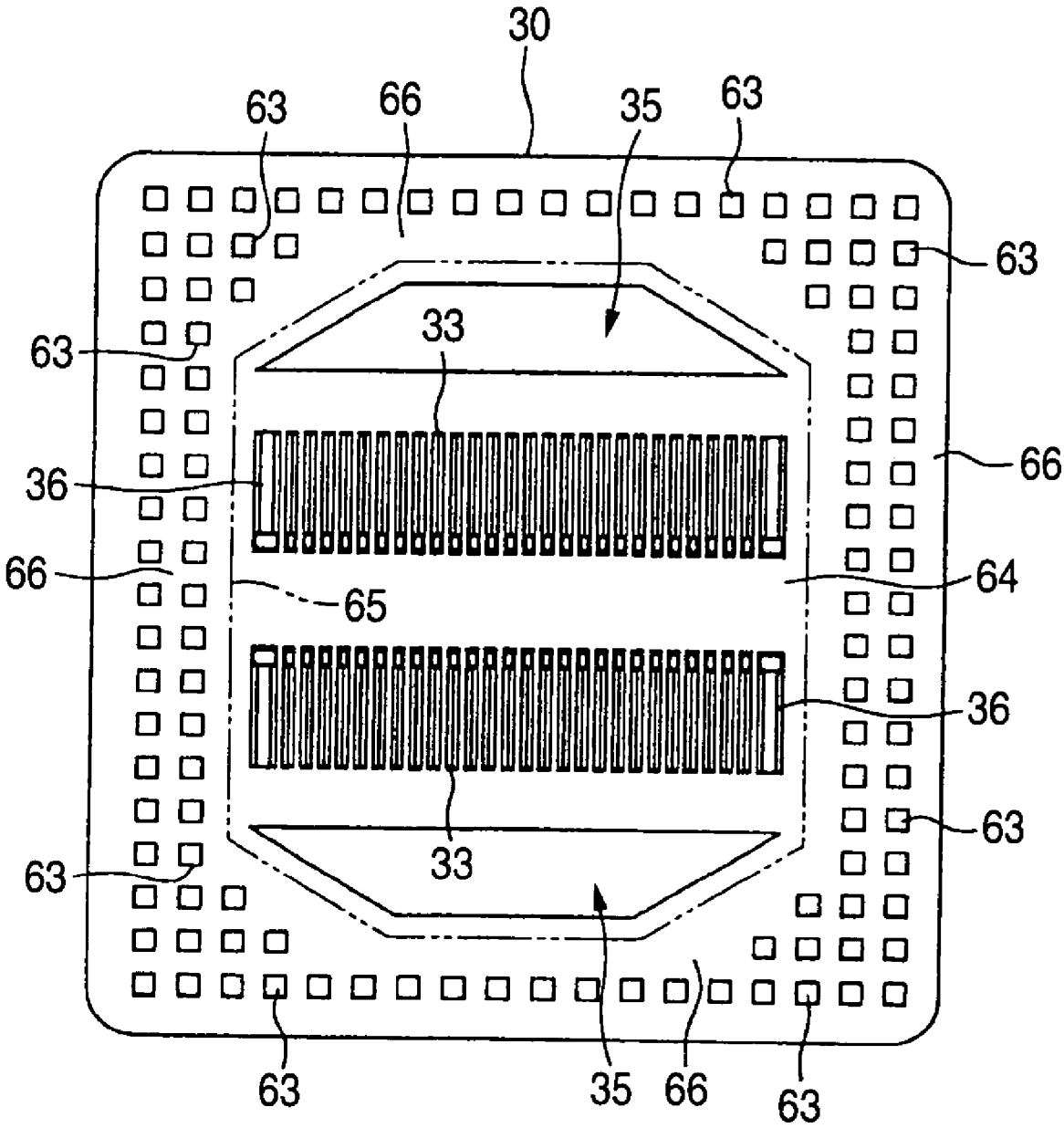
FIG. 11 is a plan view showing a chamber formation plate according to a first embodiment of the invention.

FIG. 11 shows a state where a large number of minute dents 63 are formed on the chamber formation plate 30, which is a first embodiment of the invention. A region in which elongated recess portions 33 to be pressure generating chambers 29 and escaping recess portions 35 are densely formed is a worked shape portion 64. For convenience of understanding this worked shape portion 64, it is surrounded by a dashed chain line 65. In another region 66 than the worked shape portion 64, a large number of minute dents 33 are provided. In a case shown in FIG. 11, they are arranged vertically and laterally at an equal pitch. The shape of the worked shape portion 64 surrounded by the dashed chain line 65 is not limited to the shape shown by the dashed chain line 65, but it is appropriate to understand that the shape of the worked shape portion 64 is a range in which residual stress by molding of the groove-shaped portion 33 and escaping recess portion 35 exists.

The worked shape portion 64 is located near a center of the chamber formation plate 30, and another region 66 than the worked shape portion 64 exists around the worked shape portion 64.

Figure 13:
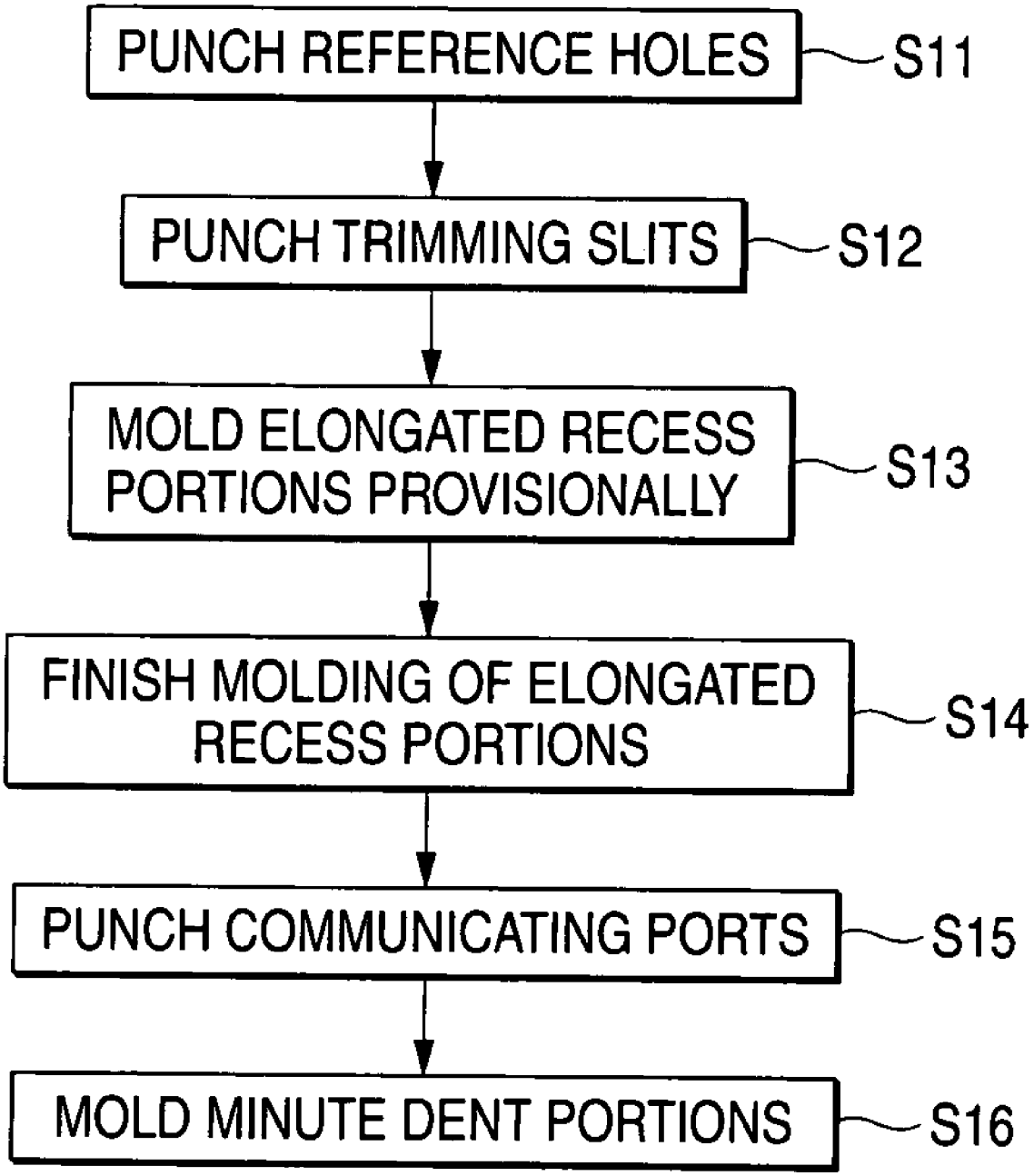
FIG. 13 is a flow chart showing a process for forming the chamber formation plate of FIG. 11.

The chamber formation plate 30 is molded usually by a multi-process type of forging machine including plural working stages. For example, a strip 55 is fed progressively to the forging machine, and working comprising the following stages progresses to a last stage as shown in FIG. 13: first working stage in which a reference hole for positioning the strip and the die is formed (step S11); a second working stage in which an opening portion for trimming is formed (step S12); a third working stage in which the elongated recess portion 33 is preliminarily molded (step S13); a fourth working stage in which molding of the elongated recess portion 33 is finished (step S14); and a fifth working stage in which a communicating port 34 is formed (step S15).

Molding of the minute dent 63 is performed in the last stage of the working stages (step S16). A die for molding the minute dent 63 includes many projection-like punches, and a leading end portion of this punch is pressed on the chamber formation plate 30 in the plate thickness direction thereby to perform such working that dents arranged regularly are given in another region 66 than the worked shape portion 64.

When this minute dent 63 is molded, a minute plastic flow is produced on a surface layer portion of the material 55, and such the minute plastic flow is accumulated, whereby the residual stress is added to another region 66 than the worked shape portion 64. Therefore, the residual stress in the worked shape portion 64 and the residual stress in another region 66 are made as uniform as possible, so that the above strain deformation is corrected or prevented. Further, in molding of the minute dent 63, another region than the worked shape portion 64 is pressed throughout a wide range, and the strain deformation is corrected or prevented. Accordingly, a chamber formation plate 30 having high flatness in which the strain deformation does not exist is obtained, so that when it is assembled as the flow path unit 4, a liquid ejection head 1 having high accuracy in assembly is obtained.

Further, since the minute dent 63 is molded by pressing the die on the chamber formation plate 30 in the plate thickness direction, plastic flow is produced surely in the chamber formation plate 30 in the region 66 where the minute dent 63 is formed, residual stress balanced with residual stress of the worked shape portion 64 is obtained, and the occurrence of the above strain deformation is prevented or the amount of strain deformation is reduced.

However, it is not necessary to perform all the above working stages in the progressive manner. For example, the first stage and the second stage may be integrated, or the minute dent formation may be performed before the fourth working stage.

A mode of strain deformation of the chamber formation plate 30 changes according to various factors such as dense degree of the molded portions of the elongated recess portions 33 in the worked shape portion 64, the number of the elongated recess portions 33 arranged in arrays, a length of the elongated recess portion 33 with respect to the size of the chamber formation plate 30, and size of another region 66 than the worked shape portion 64. As one mode of its change, the whole of the chamber formation plate 30 is curved or warped.

In such a case, the minute dents 63 are formed at least on the inner face side of the curved or warped shape thereby to correct or prevent the curve. At this time, in a surface layer portion on the curve inner face side of the chamber formation plate 30 in which the minute dent 63 is formed, a reactional force is produced in a direction where the face area of the inner face of the curved or warped shape is expanded. Therefore, the curved shape is corrected to the flat shape.

Further, in the mode of the strain deformation of the chamber formation plate 30, there are various shapes. According to the state of its strain deformation, there is a case that the minute dents 63 are formed on both faces of the chamber formation plate 30 in order to correspond to the strain deformation. In this case, the plastic flow is produced by the minute dents 63 on the both faces of the chamber formation plate 30. Therefore, the residual stress with the plastic flow is produced on the both faces of the chamber formation plate 30, whereby its residual stress balances with residual stress of the worked shape portion suitably, and the occurrence of the strain deformation is corrected or prevented.

In order to cause further positively the residual stress produced by forming the minute dents 63 on the above both faces, the minute dents 63 are arranged on the both faces of the chamber formation plate in the nearly same arrangement. Hereby, the plastic flows are formed by the minute dents 63 in portions of the nearly same arrangement on the both faces of the chamber formation plate 30. Therefore, the plastic flows to the chamber formation plate 30 progress more positively from the both faces, and the residual stresses with the plastic flows are sufficiently produced on the both faces of the chamber formation plate 30 without having a shortage, whereby the produced residual stresses balance with the residual stress in the worked shape portion 64 suitably, and the occurrence of the strain deformation is corrected or prevented.

The above "nearly same arrangement" includes a case that the deepest portions of the minute dents 63 formed by press from the both sides coincides with each other, viewed in the thickness direction of the chamber formation plate 30, and a case that the portions are slightly deviated from each other. Consequently, "nearly same arrangement" means that the plastic flows from the both sides act on occurrence of the residual stress effectively. Further, by arbitrarily selecting a region in which the minute dents 63 are formed for each face of the chamber formation plate 30, the residual stress in the region 66 can be balanced with the residual stress of the worked shape portion 64.

Figure 12A:
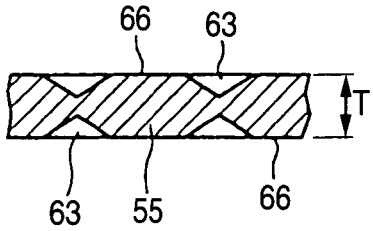
FIG. 12A is a sectional view of the minute dent.
Figure 12B:
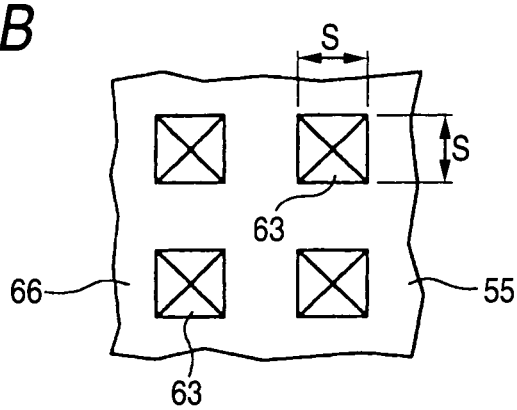
FIGS. 12B to 12D are plan views showing variations of the minute dent.
Figure 12C:
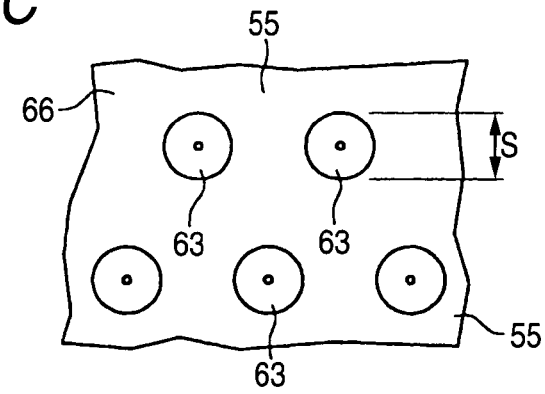
Figure 12D:
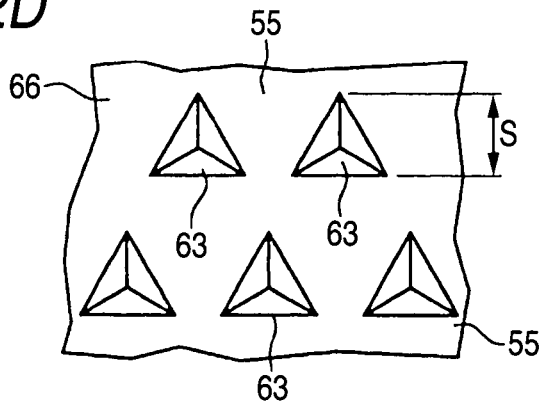

As a shape of the minute dent 63, various shapes can be adopted. FIGS. 12B to 12D show variations of the minute dents 63. FIG. 12A is a partial sectional view of the region 66 where the minute dents 63 are formed. The minute dent 63 shown here is square pyramid-shaped as shown in FIG. 12B in plane, and the punch for the minute dent 63 is also square pyramid-shaped. Further, FIG. 12C shows a conical minute dent 63, and FIG. 12D is a triangular pyramid-shaped minute dent 63.

By each minute dent 63 of the above shapes, the material 55 on the surface layer portion of the chamber formation plate 30 shows the plastic flow in the polygonal direction in a case where the minute dent 63 is polygonal pyramid-shaped. Further, in a case where the minute dent 63 is cone-shaped, the material 55 shows the plastic flow in all the directions. Therefore, good residual stress is imparted in another region 66 than the worked shape portion 64.

As shown in FIGS. 12A and 12B, an opening dimension S of the minute dent 63 is nearly the same as a plate thickness dimension T of the chamber formation plate 30 or smaller. Hereby, since the opening dimension S of the minute dent 63 is so large with respect to the plate thickness dimension T, a die is well let bite into the material 55 when the minute dent 63 is molded, so that the plastic flow of material 55 by molding of the minute dent 63 is performed suitably.

Further, the minute dent 63 is formed apart from the worked shape portion 64 by the plate thickness dimension T of the chamber formation plate 30 or more. Hereby, since an influence of the plastic flow of material 55 produced by molding of the minute dent 63 is not exerted on the worked shape portion 64, the minute dent 63 does not lower the shape or dimensional accuracy of the worked shape portion 64.

The minute dents 63 are arranged nearly at an interval of plate thickness dimension T of the chamber formation plate 30. Hereby, since the interval of the minute dent is not so large as to greatly exceed the plate thickness dimension T, the minute plastic flow of the material 55 produced by molding of the minute dent 63 can be well accumulated, so that the proper residual stress is imparted in the region 66.

As described above, the worked shape portion 64 is provided nearly in the center of the material 55 (chamber formation plate 30), and the region 66 is located around the worked shape portion 64. It is preferable that the minute dents 63 are formed at least in portions opposed to each other with the worked shape portion 64 between. In this embodiment, the minute dents 63 are formed on the nearly entire faces of the region 66. Accordingly, the relatively large residual stress by the worked shape portion 64 concentrated to the central region is balanced with the residual stress of the minute dents 63 formed around the worked shape portion 64, so that the strain deformation of the chamber formation plate 30 is corrected or prevented. Since the worked shape portion 64 located in the center of the material 55 receives corrective action from the minute dents 63 surrounding the worked shape portion 64, the strain deformation is prevented with good balance as the whole of the chamber formation plate 30.

A pitch dimension of the elongated recess portions 33 is 0.14 mm. When the pressure generating chamber 29 of the ink jet recording head, which is a precise minute member, is forged, very elaborate forging work is possible. Though the pitch dimension of the elongated recess portions 33 is 0.14 mm in the shown embodiment, by setting this pitch 0.3 mm or less, the parts work of the liquid ejection head is finished more suitably. This pitch is preferably 0.2 mm or less, and more preferably 0.15 mm or less. Further, since the density of the elongated recess portions 33 is high and accumulation of the residual stress in the worked shape portion 64 is also large, the effect of the invention which corrects or prevents the strain deformation produced by the residual stress is remarkable.

In the forging work, the material 55 is pressed by the projection 53, whereby the plastic flow of the material 55 is produced, so that a protruding portion can be formed on the face of the material 55. In order to remove this portion to form the flat face of the chamber formation plate 30, a polishing stage is executed as the last finishing stage.

The minute dents 63 remain on the face also even after the polishing, whereby the residual stress imparted by the minute dents 63 formed before polishing is continuously left as it is, balance in residual stress between the worked shape portion 64 and another region 66 is kept. Accordingly, the strain deformation is not produced in the chamber formation plate 30 after the polishing. Further, improvement of flatness of the chamber formation plate 30 by polishing makes good bondability to the other member in bonding, for example, the nozzle plate 31 and the elastic plate 32. Further, since the minute dents 63 remain, the extra adhesive is housed in the minute dents 63, the adhesive does not flow to the outside, and the layer thickness of the adhesive does not become uneven, so that a liquid ejection head 1 having good accuracy in assembly is obtained.

By including a countermeasure for preventing the strain deformation of the chamber formation plate 30 in the working stages of the chamber formation plate 30 described with reference to FIGS. 8A through 10C, a method of manufacturing an excellent liquid ejection head can be obtained.

As a working method for such minute structure, an anisotropic etching method is generally adopted. However, since this method requires a large number of working steps, it is disadvantage in manufacturing cost. On the contrary, in a case where the above forging work method is used in the material such as nickel, the number of working steps is reduced greatly, which is very advantageous in cost.

FIGS. 14A through 17 show a chamber formation plate according to a second embodiment of the invention.

In the embodiment, the excess part of an adhesive 71 bonding a chamber formation plate 30 to a sealing plate 43 is accommodated in minute dent portions 63 to avoid a bad influence on a pressure generating chamber 29. The minute dent portions 63 are provided in the chamber formation plate 30 in the vicinity of the end of a row 33*a* of elongated recess portions 33.

Figure 14A:
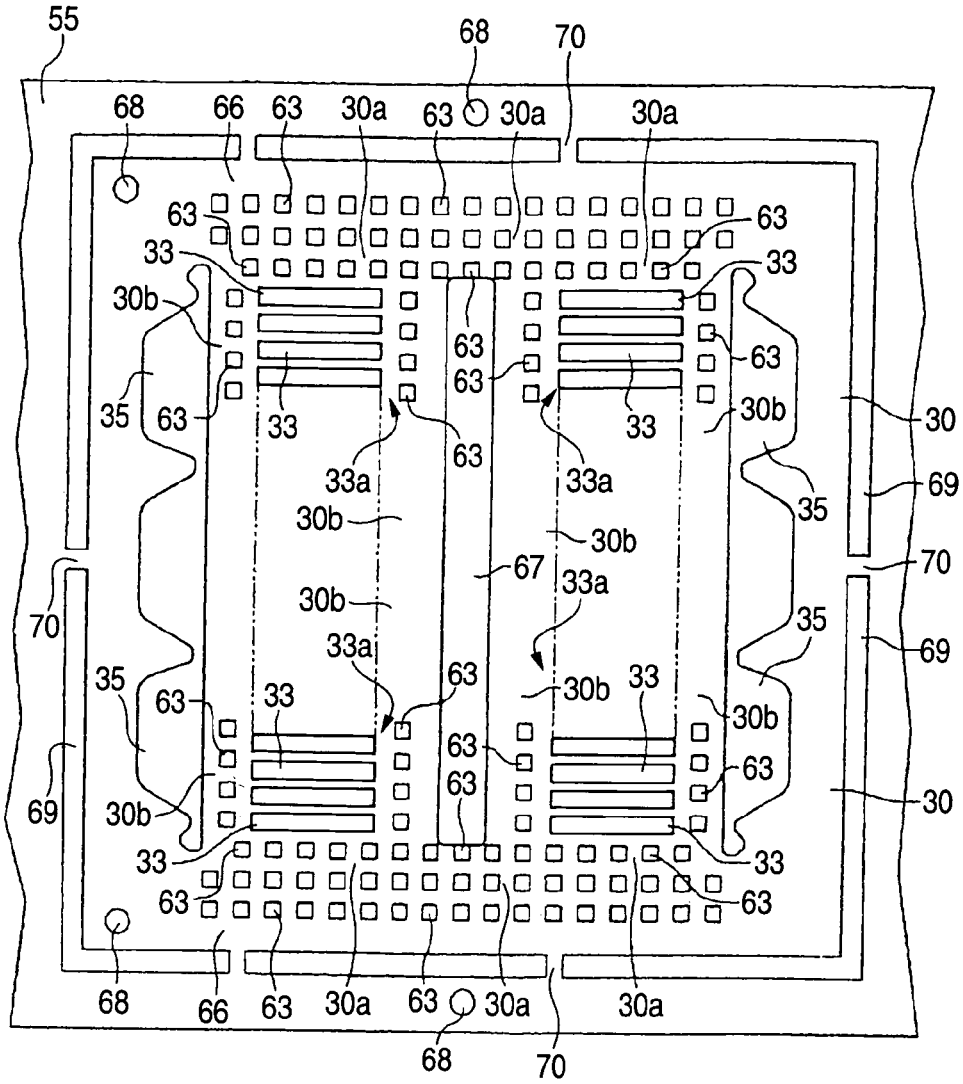
FIGS. 14A and 14B are plan views showing a chamber formation plate according to a second embodiment of the invention.

As shown in FIG. 14A, the minute dent portions 63 are provided in wide regions 30*a* of the chamber formation plate 30 extending in the vicinity of both longitudinal ends of the rows 33*a* of the elongated recess portions 33. The minute dent portions 63 are also provided in narrow regions 30*b* in the chamber formation plate 30 extending in a region between one longitudinal ends of the elongated recess portions 33 and the escaping recess portion 35, and a region between the other longitudinal ends of the elongated recess portions 33 and an intermediate recess portion 67.

When the chamber formation plate 30 and the sealing plate 43 are joined with a predetermined pressurizing force, the excess adhesive 71 flows from the wide region 30*a* to the narrow region 30*b* in a direction of the row 33*a* of the elongated recess portions 33. The amount (distance) of the flow depends on the thickness of the application of the adhesive 71, the viscosity of the adhesive 71, an environmental temperature, and the width of the narrow region 30*b*. More specifically, the excess adhesive 71 in the wide region 30*a* flows from the end of the row 33*a* of approximately 180 elongated recess portions 33 toward a portion at which the approximately 10th elongated recess portion 33 is provided. Therefore, a place of the narrow region 30*b* in which the minute dent portions 63 are to be arranged is set mainly depending on a distance at which the excess adhesive 71 flows into the narrow region 30*b*.

The minute dent portions 63 are provided at an equal pitch in the narrow region 30*b*, and the pitch of the minute dent portions 63 are almost a double of the pitch of the elongated recess portion 33 in this embodiment.

Figure 17:
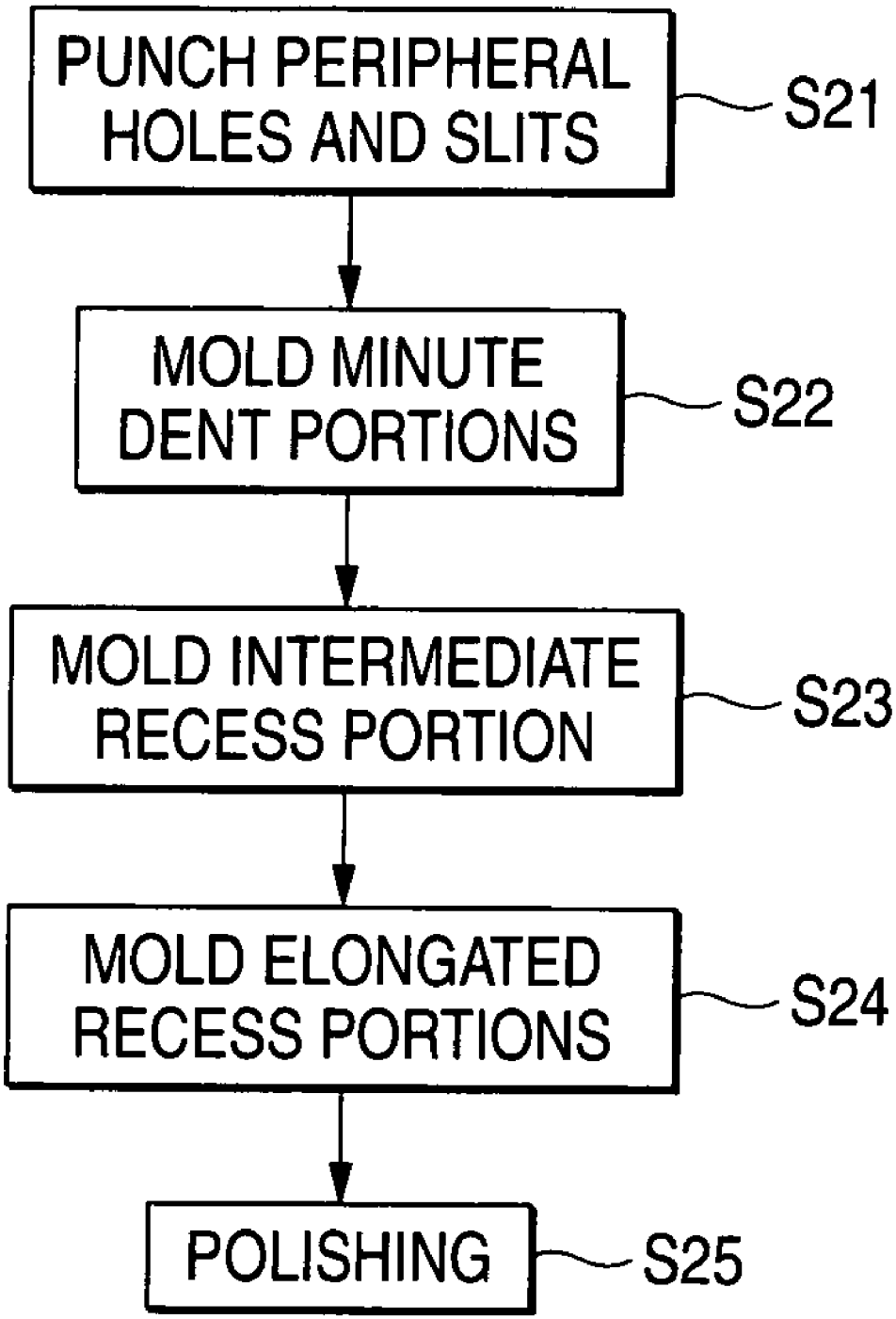
FIG. 17 is a flow chart showing a process for forming the chamber formation plate of FIG. 14.

FIG. 17 shows a process for press-working the chamber formation plate 30 illustrated in FIG. 14A. As well as the case of FIG. 13, a step of punching a peripheral portion which forms a reference hole 68 and a slit 69 for trimming on a strip 55 is set to be a first step (step S21). The chamber formation plate 30 is provided on the inside of the slit 69 for trimming. When connecting portions 70 are finally cut away, a single product of the chamber formation plate 30 is finished.

At a second step, the minute dent portions 63 are formed by punching in the vicinity of the end of the row 33*a* of the elongated recess portions 33 (step S22). At a third step, an intermediate recess portion 67 is formed between the two rows 33*a* of the elongated recess portions 33 arranged in parallel (step S23). The intermediate recess portion 67 is an elongated recess formed in advance in order to prevent a material from being bulged between the rows 33*a* due to plastic flow from the respective elongated recess portions 33 in the longitudinal direction thereof.

At a fourth step, the elongated recess portion 33 is formed by the projections 53 and 54 which are shown in FIGS. 10A to 10C (step S24). Finally, polishing is carried out over the surface of the chamber formation plate 30 so that a flat finished surface, that is, a bonded surface is formed (step S25).

Figure 15:
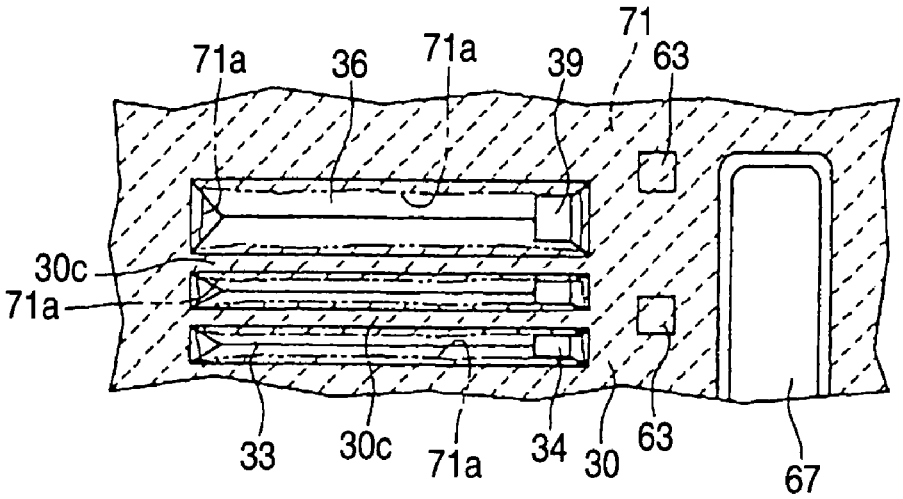
FIG. 15 is an enlarged plan view showing an inconvenient state that excess adhesive agent flows into the elongated recess portion.
Figure 16:
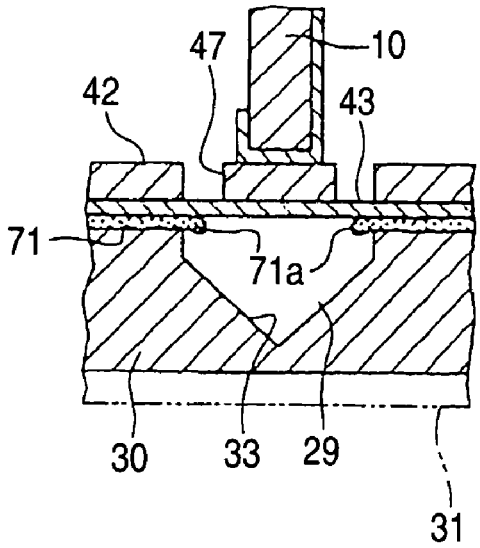
FIG. 16 is an enlarged section view showing the inconvenient state.

If an overflowing portion 71*a* of the adhesive 71 is generated as shown in FIGS. 15 and 16, the effective area of the sealing plate 43 carrying out the film vibration is decreased so that an amplitude is also reduced. Consequently, the normal ejection amount of ink cannot be maintained. As a countermeasure, it can be proposed that the driving voltage of a piezoelectric vibrator 10 coupled to the sealing plate 43 is to be raised in order to increase the amplitude of the film vibration of the sealing plate 43. However, there is the pressure generating chamber 29 having no overflowing portion 71*a* of the adhesive 71 or the amount of the overflow is varied. For this reason, it is hard to make an ink ejection property uniform for each pressure generating chamber 29.

In this embodiment, when the chamber formation plate 30 is to be bonded to the sealing plate 43 with the adhesive 71, the excess adhesive 71 to be pushed out of a portion between the chamber formation plate 30 and the sealing plate 43 is accommodated in the minute dent portions 63. Therefore, the excess adhesive 71 can be prevented from overflowing into the space portion of the elongated recess portion 33, that is, the pressure generating chamber 29 so that the normal film vibration of the sealing plate 43 can be obtained.

Since a predetermined amount of the adhesive 71 is applied onto slender regions 30*c* between adjacent elongated recess portions 33, if the excess adhesive 71 flows to the slender regions 30*c*, the adhesive 71 easily overflows into the elongated recess portion 33 to reduce the effective width of the pressure generating chamber 29.

In this embodiment, since the minute dent portions 63 are provided in the vicinity of longitudinal ends of each elongated recess portion 33, the excess adhesive 71 is accommodated in the minute dent portions 63 so that the excess adhesive 71 is prevented from flowing into the slender regions 30*c*.

The pitch of the minute dent portions 63 may be two to five times as great as the pitch of the elongated recess portions 33 provided in a row. For example, the excessive adhesive 71 is previously accommodated in the minute dent portions 63 with one minute dent portion 63 corresponding to approximately two elongated recess portions 33. Therefore, the adhesive 71 to flow toward the slender region 30*c* can be controlled to have a level which involves no substantial problem. Thus, the number of the elongated recess portions 33 associated with one minute dent portion 63 are set depending on the amount of the application of the adhesive 71, a distance between the minute dent portions 63 and the end of the elongated recess portion 33 and the width of the slender regions 30*c*, so that the optimum accommodation state of the adhesive 71 in the minute dent portions 63 can be attained.

More specifically, the surface of the chamber formation plate 30 obtained after the forging process is polished and the minute dent portions 63 remaining after the end of the polishing process is caused to serves as a portion for accommodating the excess adhesive 71 bonding the sealing plate 43 to the chamber formation plate 30. Accordingly, the flatness of the chamber formation plate 30 is enhanced by the polishing, so that an adhesion to the other member in the bonding, for example, the sealing plate 43 and the nozzle plate 31 can be improved. Moreover, since the minute dent portions 63 are caused to remain so that the excess adhesive 71 is accommodated in the minute dent portions 63, the adhesive 71 can be prevented from flowing to the outside and the thickness of the adhesive 71 can be prevented from being uneven. Thus, it is possible to obtain the recording head 1 with high precision in assembly.

Except for the arrangement of the minute dent portions 63, others produce the same advantages as those of the first embodiment.

Figure 18:
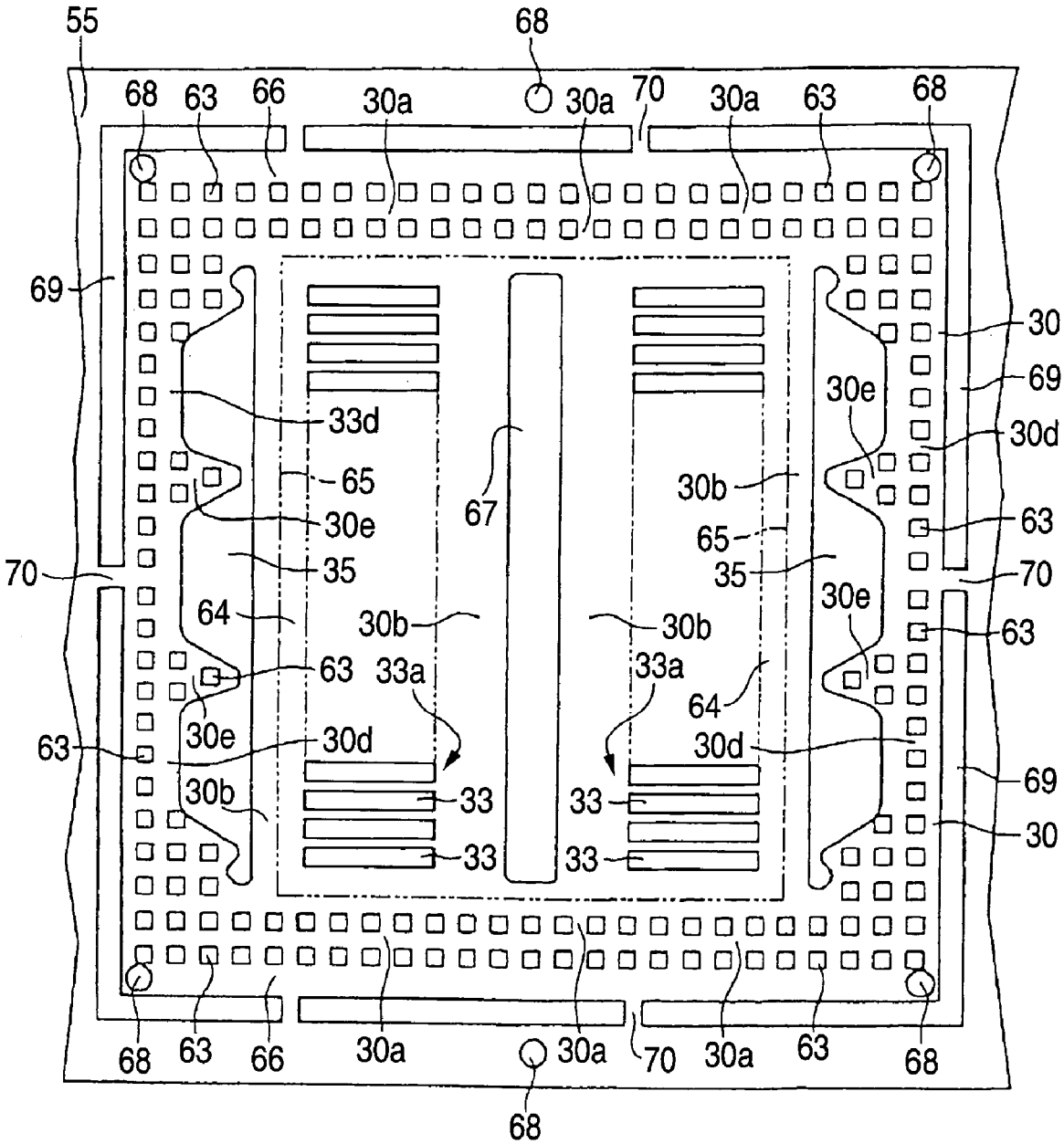
FIG. 18 is a plan view showing a chamber formation plate according to a third embodiment of the invention.
Figure 19A:
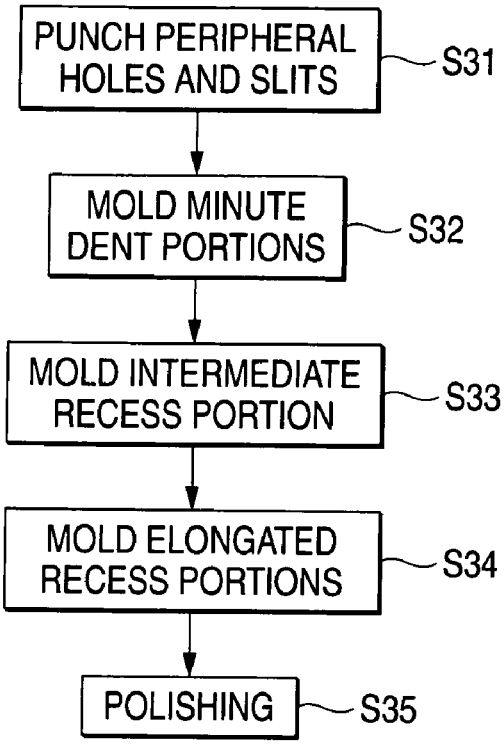
FIGS. 19A and 19B are flow charts showing alternative processes for forming the chamber formation plate of FIG. 17.
Figure 19B:
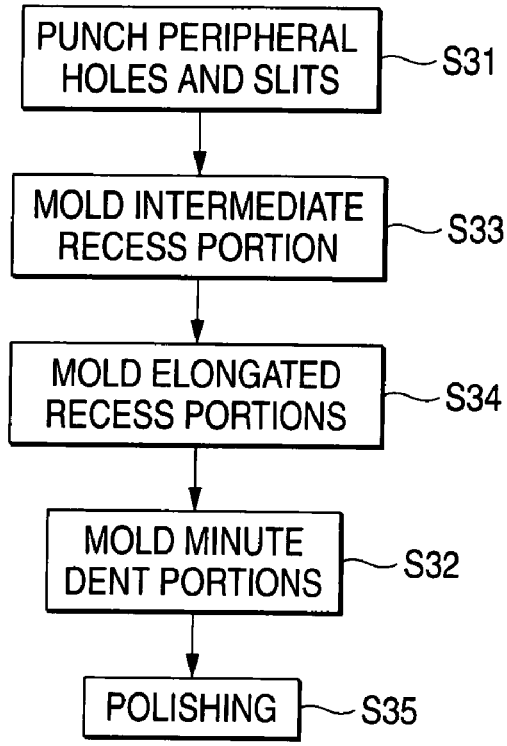

FIGS. 18 through 19B show a chamber formation plate according to a third embodiment of the invention.

In the embodiment, the minute dent portions 63 are practically used to make uniform the polished states of the worked shape portion 64 and other regions. Specifically, the minute dent portions 63 are punched at an almost uniform density over the above described wide region 30*a*, a wide region 30*d* between the escaping recess portion 35 and the trimming slit 69, and a wide region 30*e* projecting into the escaping recess portion 35. Others are the same as those in the second embodiment and the same portions are designated by the same reference numerals.

Each of the above wide regions are defined as a flat region formed with a length which is at least two to five times as great as the pitch of the elongated recess portions 33 provided in a row.

In the region in which the minute dent portions 63 are formed, a material provided around the minute dent portions 63 are bulged and a polished area is decreased. Also in the region of the worked shape portion 64 in which the elongated recess portion 33 is formed, moreover, a portion surrounding the processed portion is bulged in the same manner. Therefore, both of the bulged portions are uniformly polished quickly, and furthermore, the polished area is also made as uniform as possible. Consequently, it can be considered that the worked shape portion 64 and the minute dent portions forming parts 30*a*, 30*d* and 30*e* are finally finished to form one virtual plane. Therefore, a thickness obtained after the polishing of the chamber formation plate 30 is uniform over the whole region. Accordingly, a man hour of remedy polishing or the like can be reduced, which is effective for reducing a manufacturing cost and shortening a time required for the polishing.

Except for the arrangement of the minute dent portions 63, others produce the same advantages as those of the first and second embodiments.

FIGS. 19A and 19B show alternative processes for press-working the chamber formation plate 30 illustrated in FIG. 18. In the process shown in FIG. 19A, a first step is a step of forming the reference hole 68 and the trimming slit 69 on a strip 55 by punching (step S31). A second step is a step of forming the minute dent portions 63 for the wide regions 30*a*, 30*d* and 30*e* (step S32). A third step is a step of forming the intermediate recess portion 67 (step S33). A fourth step is a step of forming elongated recess portions 33 by the projections 53 and 54 as shown in FIGS. 10A to 10C (step S34). A fifth step is a polishing step (step S35).

In this embodiment, as shown in FIG. 19B, the step S33 and the step S34 may be performed before the step S32.

Figure 20:
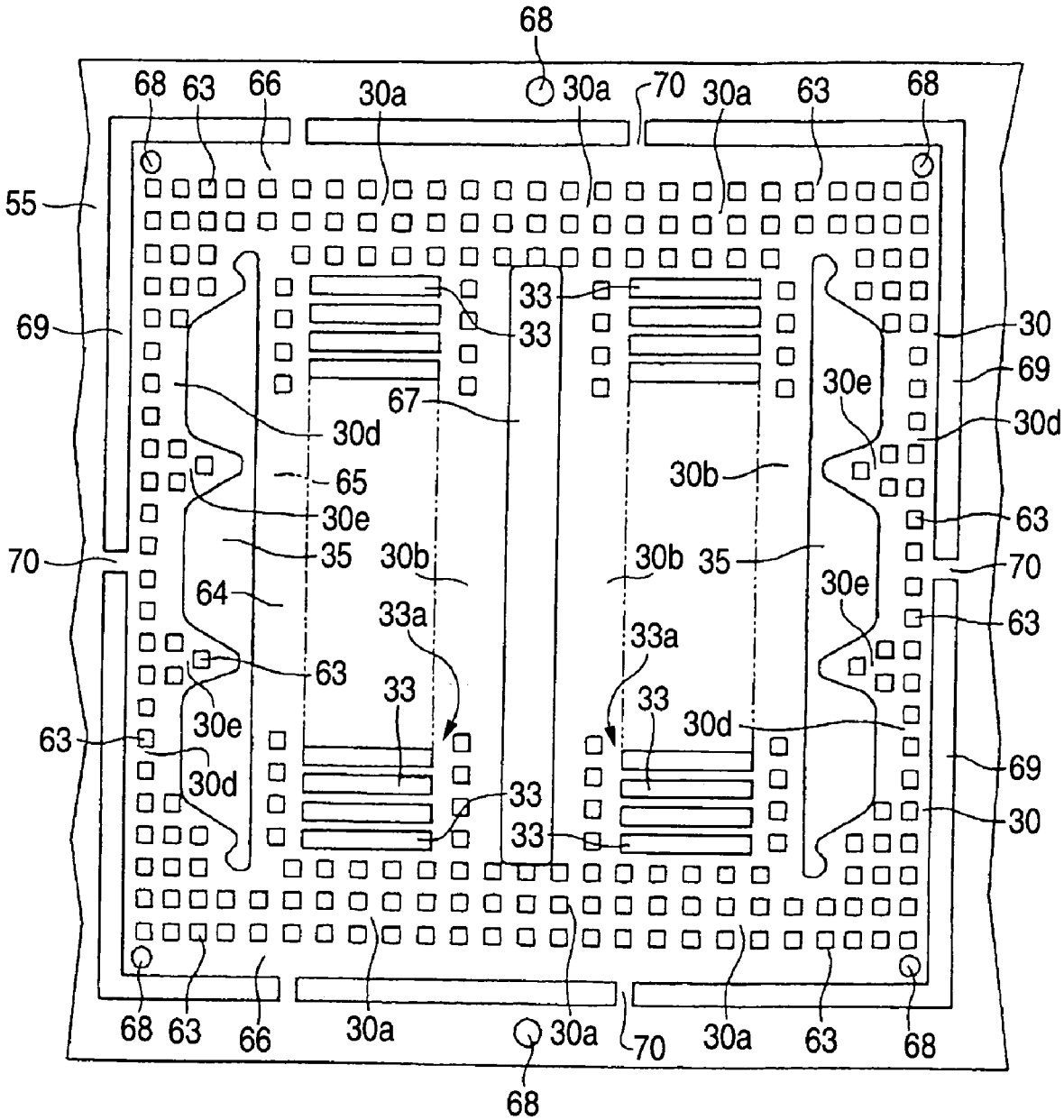
FIG. 20 is a plan view showing a chamber formation plate according to a fourth embodiment of the invention.
Figure 21:
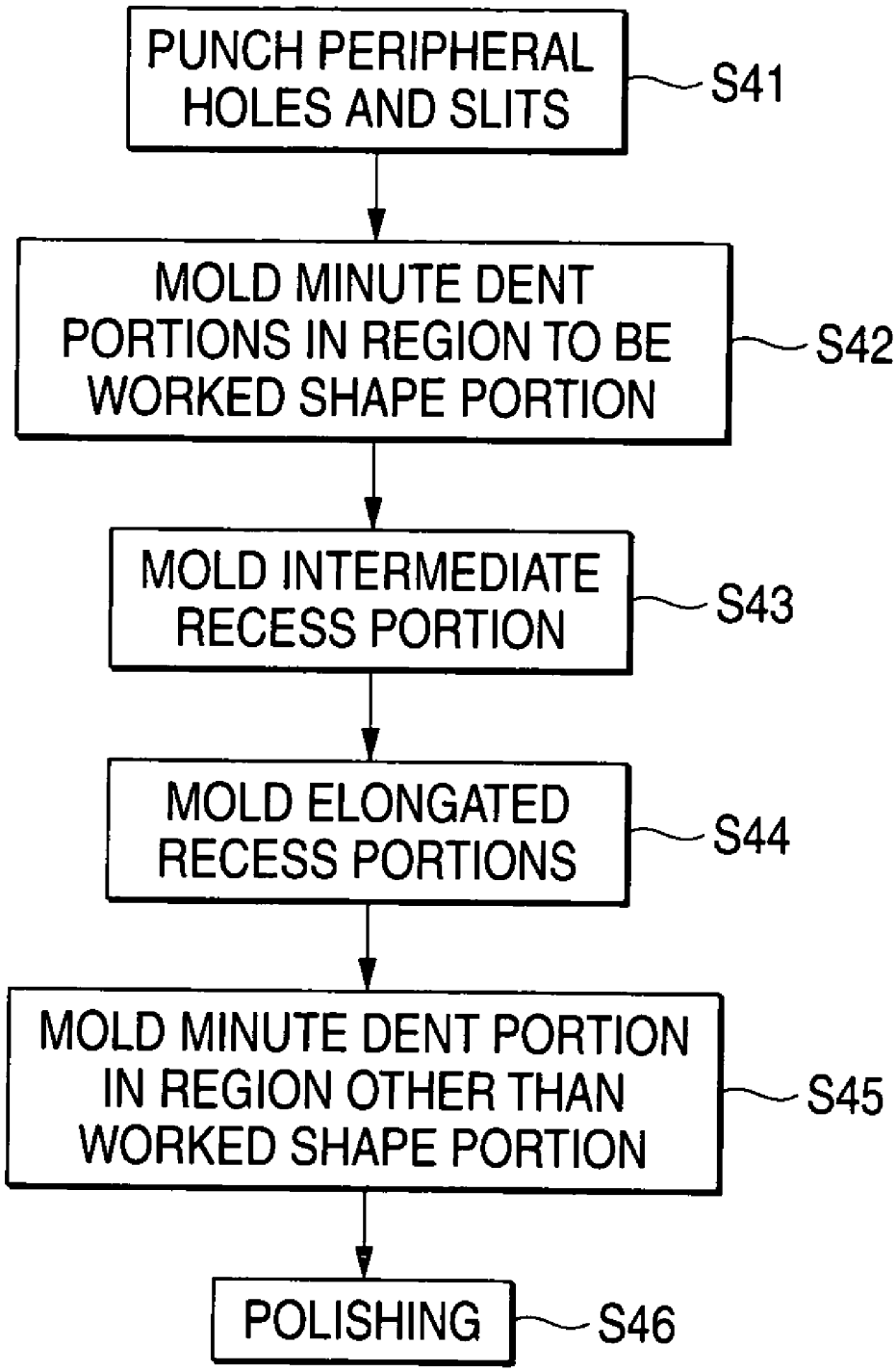
FIG. 21 is a flow chart showing a process for forming the chamber formation plate of FIG. 20.

FIGS. 20 and 21 show a chamber formation plate according to a fourth embodiment of the invention.

This embodiment is what the second embodiment and the third embodiment are combined. FIG. 21 shows a process for press-working a chamber formation plate 30 illustrated in FIG. 20. A first step is the same step as that in each of the second and third embodiments (step S41). A second step is the same step of forming the minute dent portions 63 in the vicinity of the end of the row 33*a* of elongated recess portions 33 as that in the second embodiment (step S42). Third and fourth steps are the same steps of forming the intermediate recess portion 67 and the elongated recess portion 33 as those in the second and third embodiments (steps S43 and S44). A fifth step is the same step of forming the minute dent portions 63 in a region other than a worked shape portion 64 as that in the third embodiment (step S45). A final sixth step is the same step of polishing the surface of the chamber formation plate 30 as that of each of the second and third embodiments (step S46). In this embodiment, the formation of the minute dent portions 63 in the region other than the worked shape portion 64 at the fifth step may be carried out simultaneously with the second step. Others are the same as those in the second and third embodiments and the same portions are designated by the same reference numerals.

With the structure, it is possible to prevent an excess adhesive 71 from overflowing into a pressure generating chamber 29, to uniformly polish the whole region of the chamber formation plate 30 and to correct and prevent the strain and deformation of the chamber formation plate 30.

Figure 14B:
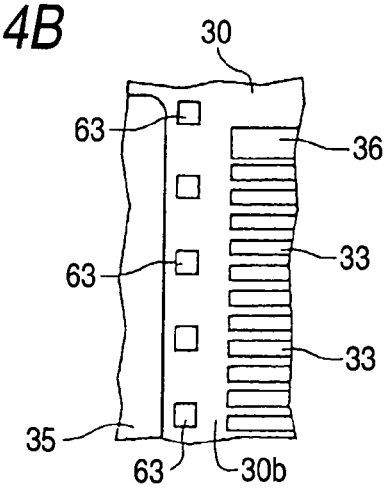

Referring to the relationship between the pitch of the elongated recess portion 33 and that of the minute dent portions 63 in FIGS. 14A, 18 and 20, the pitch of the elongated recess portion 33 is shown with exaggeration. FIGS. 11 and 14B show the actual relationship between both of the pitches.

Figure 22:
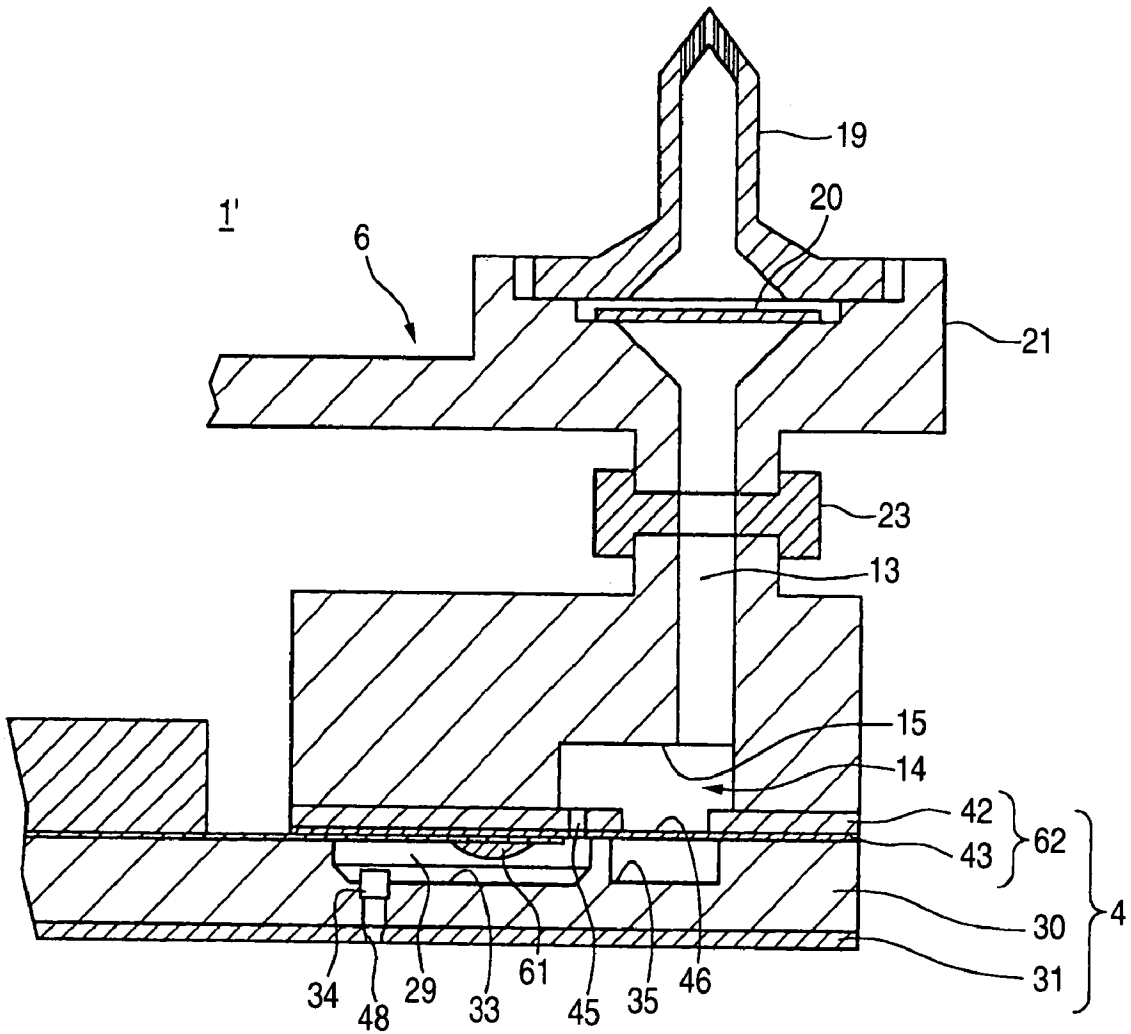
FIG. 22 is a sectional view for explaining an ink jet recording head according to a second example.

As a second embodiment, a recording head 1' shown in FIG. 22 adopts a heat generating element 61 as the pressure generating element. According to the embodiment, in place of the elastic plate 32, a sealing board 62 provided with the compliance portion 46 and the ink supply port 45 is used and the side of the elongated recess portion 33 of the chamber formation plate 30 is sealed by the sealing board 62. Further, the heat generating element 61 is attached to a surface of the sealing board 62 at inside of the pressure generating chamber 29. The heat generating element 61 generates heat by feeding electricity thereto via an electric wiring.

Since other constitutions of the chamber formation plate 30, the nozzle plate 31 and the like are similar to those of the above-described embodiments, explanations thereof will be omitted.

In the recording head 1', by feeding electricity to the heat generating element 61, ink at inside of the pressure generating chamber 29 is bumped and bubbles produced by the bumping presses ink at inside of the pressure generating chamber 29, so that ink drops are ejected from the nozzle orifice 48.

Even in the case of the recording head 1', since the chamber formation plate 30 is fabricated by plastic working of metal, advantages similar to those of the above-described embodiments are achieved.

With regard to the communicating port 34, although according to the above-described embodiments, an example of providing the communicating port 34 at one end portion of the elongated recess portion 33 has been explained, the invention is not limited thereto. For example, the communicating port 34 may be formed substantially at center of the elongated recess portion 33 in the longitudinal direction and the ink supply ports 45 and the common ink reservoirs 14 communicated therewith may be arranged at both longitudinal ends of the elongated recess portion 33. Thereby, stagnation of ink at inside of the pressure generating chamber 29 reaching the communicating port 34 from the ink supply ports 45 can be prevented.

Further, although according to the above-described embodiments, an example of applying the invention to the recording head used in the ink jet recording apparatus has been shown, an object of the liquid ejection head to which the invention is applied is not constituted only by ink of the ink jet recording apparatus but glue, manicure, conductive liquid (liquid metal) or the like can be ejected.

For example, the invention is applicable to a color filter manufacturing apparatus to be used for manufacturing a color filter of a liquid-crystal display. In this case, a coloring material ejection head of the apparatus is an example of the liquid ejection head. Another example of the liquid ejection apparatus is an electrode formation apparatus for forming electrodes, such as those of an organic EL display or those of a FED (Field Emission Display). In this case, an electrode material (a conductive paste) ejection head of the apparatus is an example of the liquid ejection head. Still another example of the liquid ejection apparatus is a biochip manufacturing apparatus for manufacturing a biochip. In this case, a bio-organic substance ejection head of the apparatus and a sample ejection head serving as a precision pipette correspond to examples of the liquid ejection head. The liquid ejection apparatus of the invention includes other industrial liquid ejection apparatuses of industrial application.

What is claimed is:

1. A liquid ejection head, comprising:

a metallic chamber formation plate, having a first region in which a plurality of pressure generating chambers are formed, and a second region in which a plurality of dents are formed, wherein each of the dents prevents ink from flowing therein; and a metallic nozzle plate, formed with a plurality of nozzles, the nozzle plate joined to the chamber formation plate such that each of the nozzles is communicated with one of the pressure generating chambers.

2. The liquid ejection head as set forth in claim 1, wherein the dents are formed on at least one of main faces of the chamber formation plate.

3. The liquid ejection head as set forth in claim 2, wherein a position of one of the dents formed on one main face of the chamber formation plate is made coincident with a position of one of the dents formed on the other main face of the chamber formation plate, when viewed from one of the main faces.

4. The liquid ejection head as set forth in claim 1, wherein each of the dents has a pyramidal shape.

5. The liquid ejection head as set forth in claim 1, wherein each of the dents has a conical shape.

6. The liquid ejection head as set forth in claim 1, wherein a size of each of the dents is not greater than a thickness of the chamber formation plate.

7. The liquid ejection head as set forth in claim 1, wherein each of dents is formed at a portion away from the first region by a distance not less than a thickness of the chamber formation plate.

8. The liquid ejection head as set forth in claim 1, wherein the dents are arranged with an interval which is substantially equal to a thickness of the chamber formation plate.

9. The liquid ejection head as set forth in claim 1, wherein the chamber formation plate is comprised of nickel.

10. The liquid ejection head as set forth in claim 1, wherein the first region is located at a center portion of the chamber formation plate and is surrounded by the second region.

11. The liquid ejection head as set forth in claim 10, wherein the dents are formed at positions opposed to each other with the first region between.

12. The liquid ejection head as set forth in claim 1, wherein the pressure generating chamber are arranged with an interval which is not greater than 0.3 mm.

13. The liquid ejection head as set forth in claim 1, wherein the first region and the second region are partly overlapped at a third region adjacent to both longitudinal ends of the pressure generating chambers.

14. The liquid ejection head as set forth in claim 13, wherein the dents in the third region are arranged with a fixed pitch which is two to five times as great as a pitch of which the pressure generating chamber is arranged side by side.

15. The liquid ejection head as set forth in claim 1, wherein the second region is provided with a length which is two to five times as great as a pitch of which the pressure generating chamber is arranged side by side.

* * * * *